US010930450B2

(12) United States Patent
Chao

(10) Patent No.: US 10,930,450 B2
(45) Date of Patent: Feb. 23, 2021

(54) KEYSWITCH

(71) Applicant: DARFON ELECTRONICS CORP., Taoyuan (TW)

(72) Inventor: Ling-Hsi Chao, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/691,533

(22) Filed: Nov. 21, 2019

(65) Prior Publication Data

US 2020/0395178 A1 Dec. 17, 2020

(30) Foreign Application Priority Data

Jun. 14, 2019 (TW) ..... 108120673

(51) Int. Cl.
*H01H 13/52* (2006.01)
*H01H 13/14* (2006.01)

(52) U.S. Cl.
CPC ..... *H01H 13/52* (2013.01); *H01H 13/14* (2013.01); *H01H 2221/04* (2013.01); *H01H 2221/068* (2013.01)

(58) Field of Classification Search
CPC .... H01H 13/52; H01H 13/14; H01H 2221/04; H01H 13/85
USPC ..... 200/5 A, 337, 344
See application file for complete search history.

(56) References Cited

U.S. PATENT DOCUMENTS

2017/0365423 A1* 12/2017 Hsu ..... H01H 13/7065
2019/0155401 A1* 5/2019 Chen ..... G06F 3/0221

FOREIGN PATENT DOCUMENTS

| | | | |
|---|---|---|---|
| CN | 207474351 | U | 6/2018 |
| CN | 106803469 | B | 12/2018 |
| CN | 109065392 | A | 12/2018 |
| TW | 201640545 | A | 11/2016 |
| TW | 201919080 | A | 5/2019 |

* cited by examiner

*Primary Examiner* — Edwin A. Leon
*Assistant Examiner* — Iman Malakooti
(74) *Attorney, Agent, or Firm* — Winston Hsu

(57) ABSTRACT

A keyswitch includes a keycap, first and second base plate, a supporting device, and a bracket. The keycap moves between an upward position and a downward position through the supporting device. The bracket is movably disposed between the keycap and the first base. The second base plate is disposed opposite to the first base plate and moves between an operation position and a storage position. When the second base plate is located at the operation position, the bracket abuts against a supporting portion of the second base plate, and a magnetic attraction force produced by two magnetic areas of the first base plate and the bracket respectively keeps the keycap at the upward position. When the second base plate is located at the storage position, the bracket is separated from the supporting portion, and the magnetic attraction force keeps the keycap at the downward position.

15 Claims, 24 Drawing Sheets

KEYSWITCH

BACKGROUND OF THE INVENTION

1. Field of the Invention

The present invention relates to a keyswitch, and more particularly to a keyswitch which uses a magnetic attraction force to make its keycap move between an upward position and a downward position through its supporting device.

2. Description of the Prior Art

For the current personal computer usage habits, a keyboard is one of the most common input devices and is used for inputting characters, symbols or numerals. Furthermore, consumer electronic products or industrial machining equipment are also equipped with an input device with keyswitches for operating the electronic products or industrial machining equipment.

Please refer to FIG. 1, which is a sectional view of a keyswitch 1 in the prior art. As shown by FIG. 1, the keyswitch 1 includes a base plate 10, a keycap 12, a circuit board 14, a supporting device 16, and a resilient part 18. The circuit board 14 is disposed on the base plate 10. The supporting device 16 is disposed between the keycap 12 and the base plate 10 for supporting the keycap 12. The resilient part 18 is also disposed between the keycap 12 and the base plate 10. After the key cap 12 is pressed by a user, the resilient part 18 provides an elastic restoration force for returning the keycap 12 to the original position where the keycap 12 is not pressed. The resilient part 18 is usually made of rubber. Because rubber may get fatigue after being used for a long time, the lifetime of the keyswitch 1 may be reduced. Furthermore, the resilient part 18 normally supports the keycap 12 to a fixed height, which is not conducive to a reduction in the whole height of a keyboard having the keyswitch 1 when the keyboard is not in use.

SUMMARY OF THE INVENTION

An objective of the invention is to provide a keyswitch, which uses a magnetic attraction force to make its keycap thereof move between an upward position and a downward position through its supporting device.

A keyswitch of an embodiment according to the invention includes a keycap, a first base plate, a supporting device, a bracket, and a second base plate. The first base plate has a first magnetic area. The supporting device is disposed between the keycap and the first base plate. The keycap moves between an upward position and a downward position through the supporting device. The bracket is movably disposed between the keycap and the first base plate. The bracket has a second magnetic area opposite to the first magnetic area. The second base plate is disposed opposite to the first base plate. The second base plate moves between an operation position and a storage position. The second base plate has a supporting portion. When the second base plate is located at the operation position, the bracket abuts against the supporting portion, and a magnetic attraction force between the second magnetic area and the first magnetic area keeps the keycap at the upward position. When the second base plate is located at the storage position, the bracket is separated from the supporting portion, and the magnetic attraction force keeps the keycap at the downward position.

A keyswitch of another embodiment according to the invention includes a keycap, a first base plate, a supporting device, a bracket, and a second base plate. The first base plate has a first magnetic area. The supporting device is disposed between the keycap and the first base plate. The keycap moves between an upward position and a downward position through the supporting device. The bracket is movably disposed between the keycap and the first base plate. The bracket has a second magnetic area opposite to the first magnetic area. The second base plate is disposed opposite to the first base plate. The second base plate moves between an operation position and a storage position. The second base plate has a supporting portion. The bracket abuts against the supporting portion. When the second base plate is located at the operation position, a magnetic attraction force between the second magnetic area, and the first magnetic area keeps the keycap at the upward position. When the second base plate moves from the operation position to the storage position, the bracket and the supporting device moves in response to the supporting position, the keycap moves from the upward position to the downward position through the supporting device, and the magnetic attraction force keeps the keycap at the downward position.

A keyswitch of another embodiment according to the invention includes a keycap, a first base plate, a supporting device, a bracket, and a second base plate. The first base plate has a first magnetic area and a slight protrusion. The supporting device is disposed between the keycap and the first base plate. The keycap moves between an upward position and a downward position through the supporting device. The bracket movably is disposed between the keycap and the first base plate. The bracket has a second magnetic area opposite to the first magnetic area. The second base plate is disposed opposite to the first base plate. The second base plate moves between an operation position and a storage position. The second base plate has a supporting portion. When the second base plate is located at the operation position, the supporting portion of the second base plate pushes up the slight protrusion of the first base plate so that the bracket abuts against the slight protrusion, and a magnetic attraction force between the second magnetic area and the first magnetic area keeps the keycap at the upward position. When the second base plate is located at the storage position, the supporting portion and the slight protrusion are staggered so that the slight protrusion is away from the bracket, and the magnetic attraction force keeps the keycap at the downward position.

As described above, in the keyswitch according to the invention, the bracket is movably disposed between the keycap and the first base plate. The second magnetic area is disposed on the bracket. Therein, the second magnetic area is disposed opposite to the first magnetic area of the first base plate. Furthermore, the second base plate is disposed opposite to the first base plate. The second base plate moves between the operation position and the storage position. When the second base plate is located at the operation position, the magnetic attraction force between the second magnetic area and the first magnetic area can keep the keycap at the upward position. When the keycap is pressed by an external force such that the second magnetic area moves away from the first magnetic area, the keycap is moved from the upward position to the downward position through the supporting device. When the external force is removed from the keycap, the magnetic attraction force makes the second magnetic area approach the first magnetic area, so that the keycap is moved from the downward position back to the upward position through the supporting device. Because the keyswitch according to the invention has no need of the resilient part used in the keyswitch in the prior art, the lifetime of the keyswitch according to the invention can be elongated.

In another aspect, when the second base plate is located at the storage position, the keycap moves from the upward position to the downward position through the supporting device, and the magnetic attraction force between the second magnetic area and the first magnetic area can keep the keycap at the downward position. Therefore, when a keyboard with the keyswitch according to the invention is not in use, a user can move the second base plate from the operation position to the storage position to reduce the height of the keyswitch for convenience of the storage of the keyboard.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
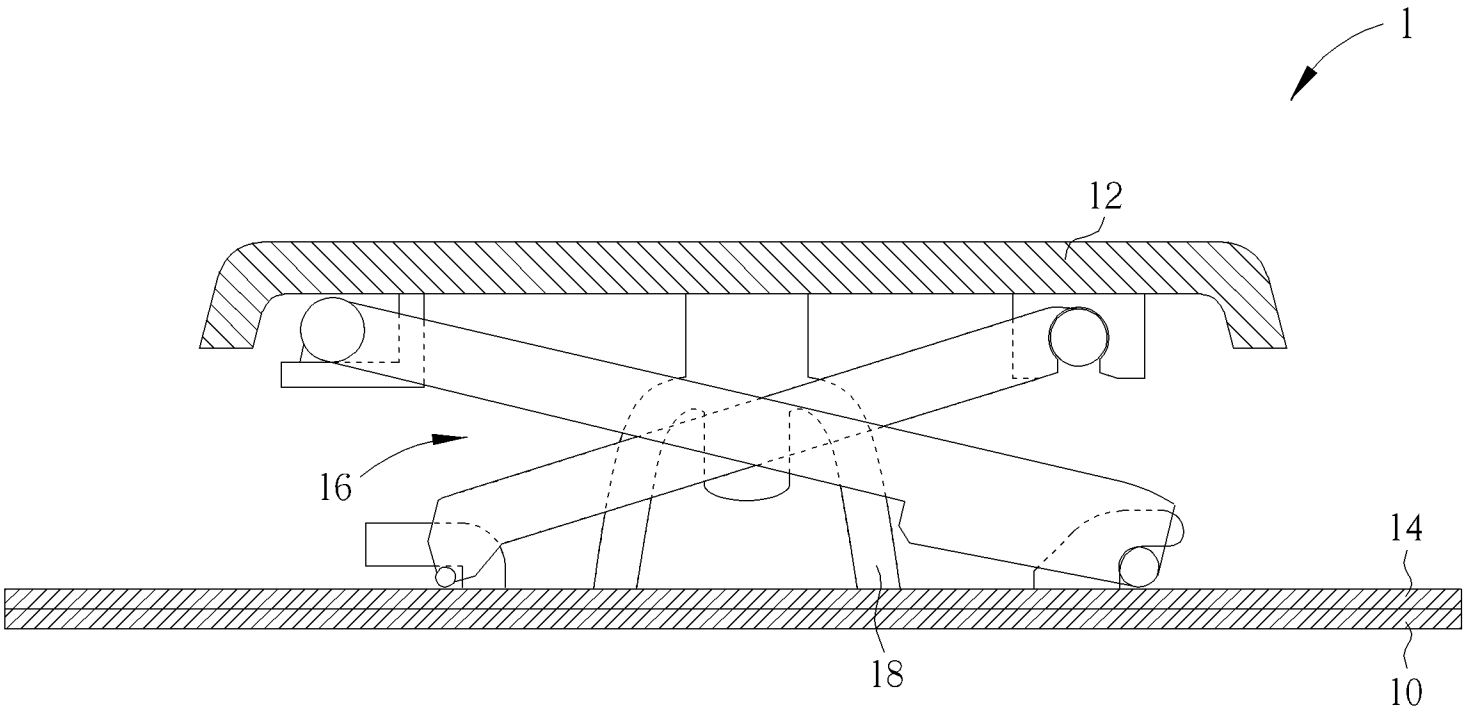
FIG. 1 PRIOR ART
FIG. 1 is a sectional view of a keyswitch in the prior art.
Figure 2:
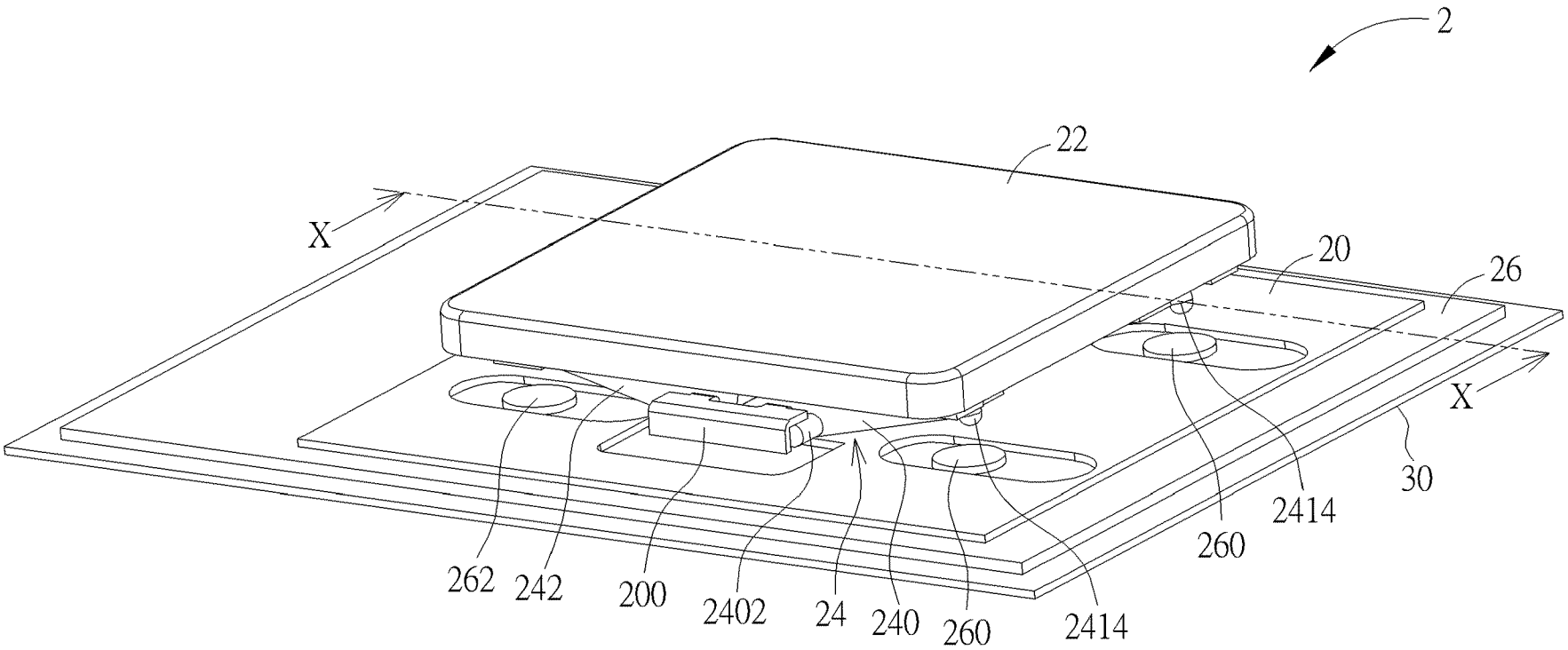
FIG. 2 is a schematic diagram illustrating a keyswitch of an embodiment according to the invention.
Figure 3:
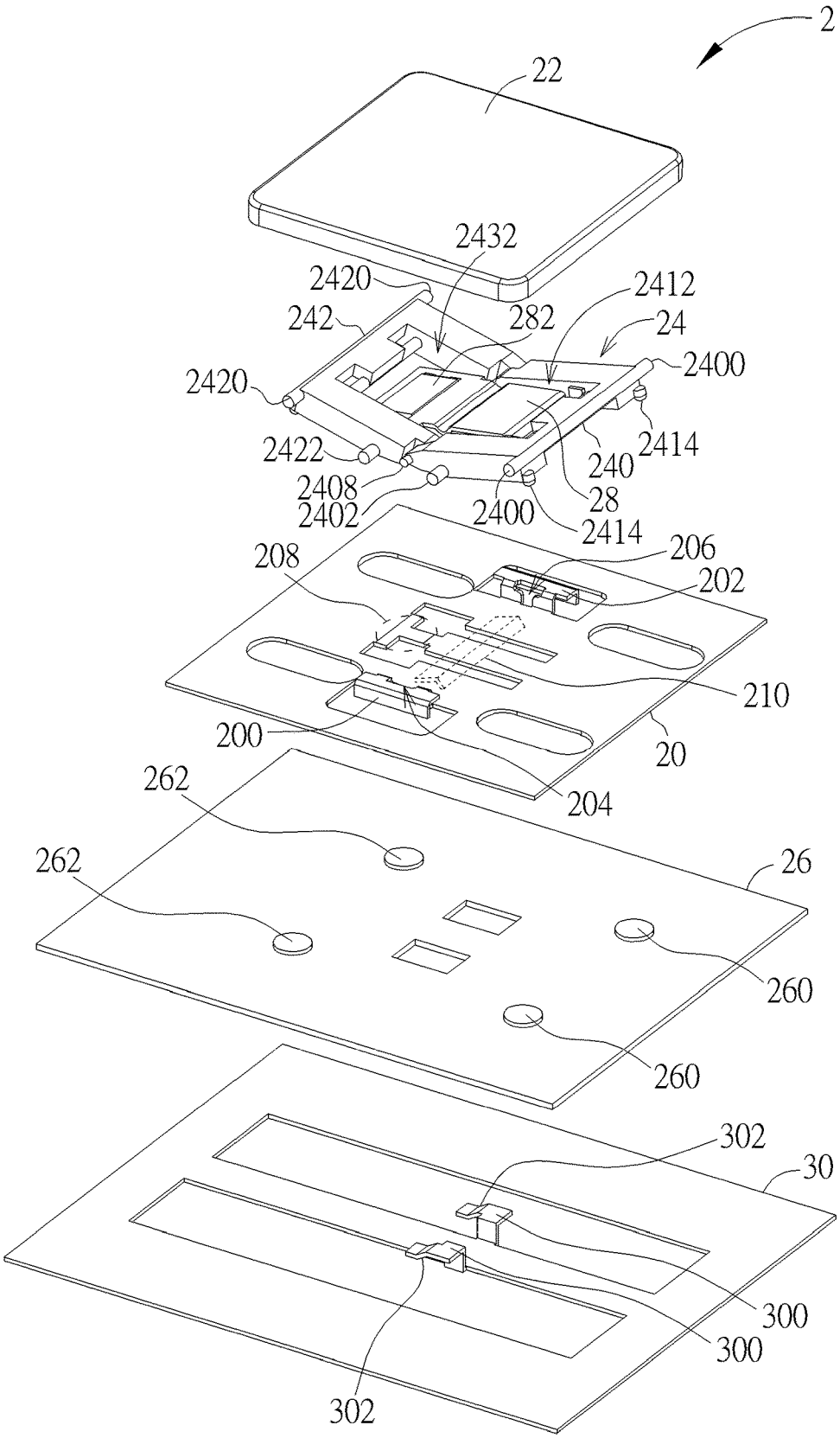
FIG. 3 is an exploded view of the keyswitch in FIG. 2.
Figure 4:
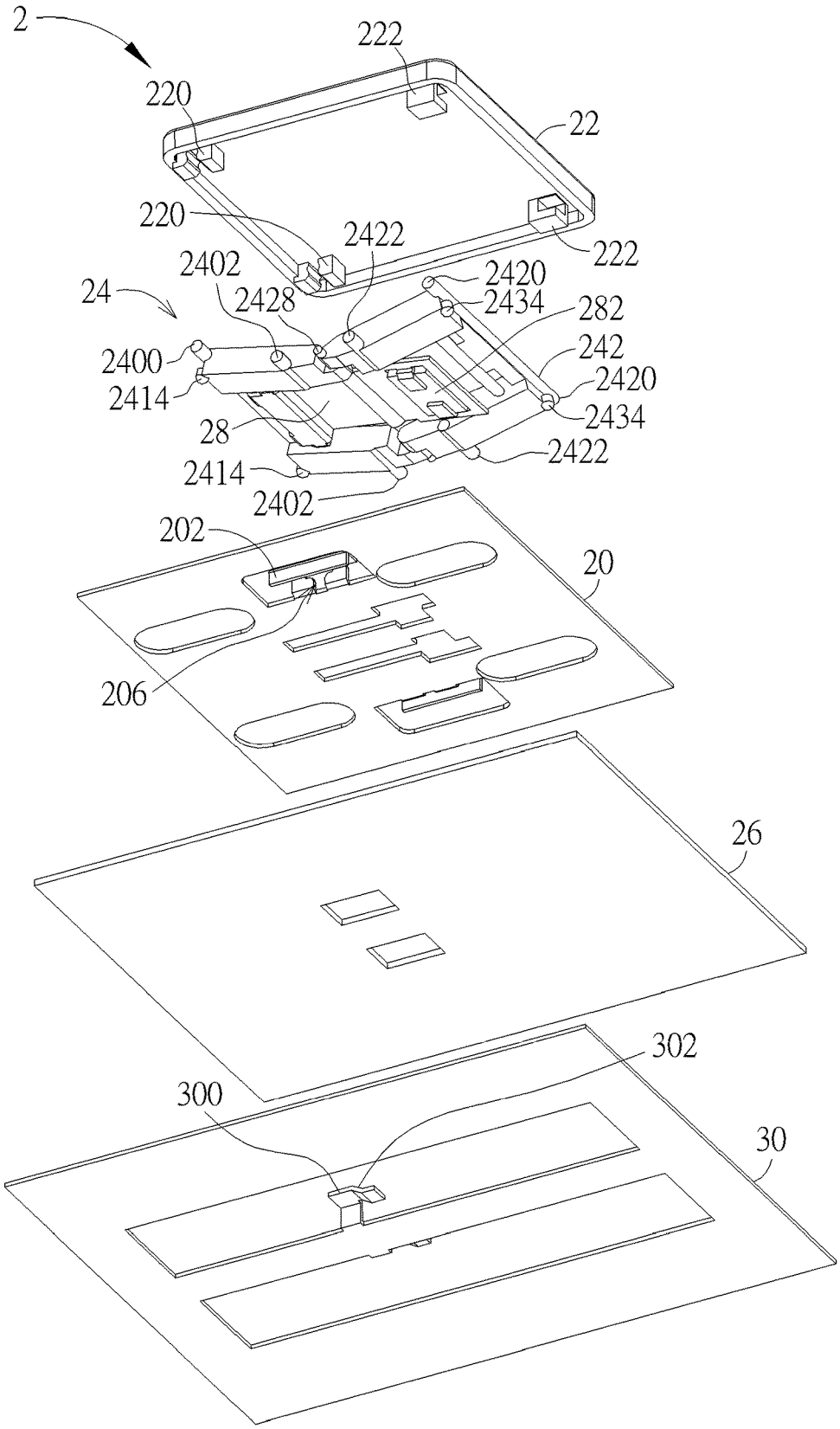
FIG. 4 is an exploded view of the keyswitch in FIG. 2 in another view point.
Figure 5:
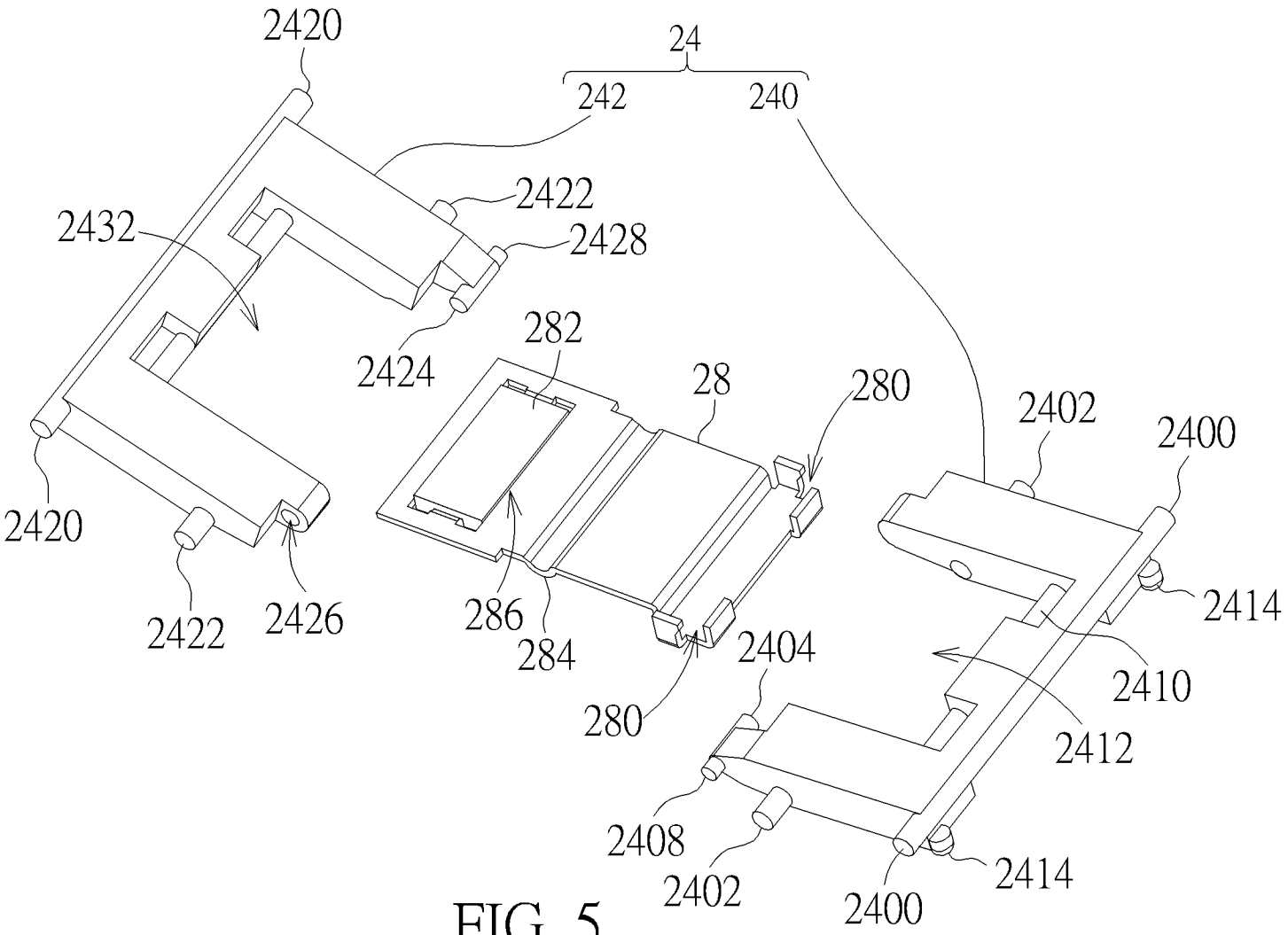
FIG. 5 is an exploded view of a supporting device and a bracket of the keyswitch in FIG. 3.

Please refer to FIG. 2 to FIG. 12. A keyswitch 2 of an embodiment according to the invention includes a first base plate 20, a keycap 22, a supporting device 24, a circuit board 26, a bracket 28, and a second base plate 30. In practice, the circuit board 26 can be but not limited to a membrane circuit board.

The supporting device 24 is disposed between the keycap 22 and the first base plate 20. In the embodiment, the supporting device 24 includes two supports 240 and 242, each of which forms a U-shaped structure that has an open side and is constructed by a horizontal section and two arm sections. The horizontal section is substantially perpendicular to the two arm sections. The support 240 has two connection portions 2400 and 2402 at each of two opposite sides thereof, which are parallel to the horizontal section. Therein, the connection portions 2400 are located at the outer sides of the arm sections close to the horizontal section and rotatably connected to connection sockets 220 of the keycap 22; the connection portions 2402 are located at the outer sides of the arm sections close to the ends of the arm sections and rotatably connected to connection sockets 200 of the first base plate 20. The support 242 has two connection portions 2420 and 2422 at each of two opposite sides thereof, which are parallel to the horizontal section. Therein, the connection portions 2420 are located at the outer sides of the arm sections close to the horizontal section and rotatably connected to connection sockets 222 of the keycap 22; the connection portions 2422 are located at the outer sides of the arm sections close to the ends of the arm sections and rotatably connected to connection sockets 202 of the first base plate 20. It is noted that the supporting device 24 also can be movably connected and/or pivotally connected to the keycap 22 and the first base plate 20 by other ways according to actual applications, not limited to the above embodiment. In the embodiment, the tow supports 240 and 242 of the supporting device 24 connect with each other through end portions thereof so as to form a supporting device of a butterfly type (i.e. a V-shaped structure). However, in another instance, it is practicable to connect the two supports of the supporting device through middle portions thereof so as to form a supporting device of a scissors type (i.e. an X-shaped structure). The design of the connection of the supports depends on actual applications.

Figure 7:
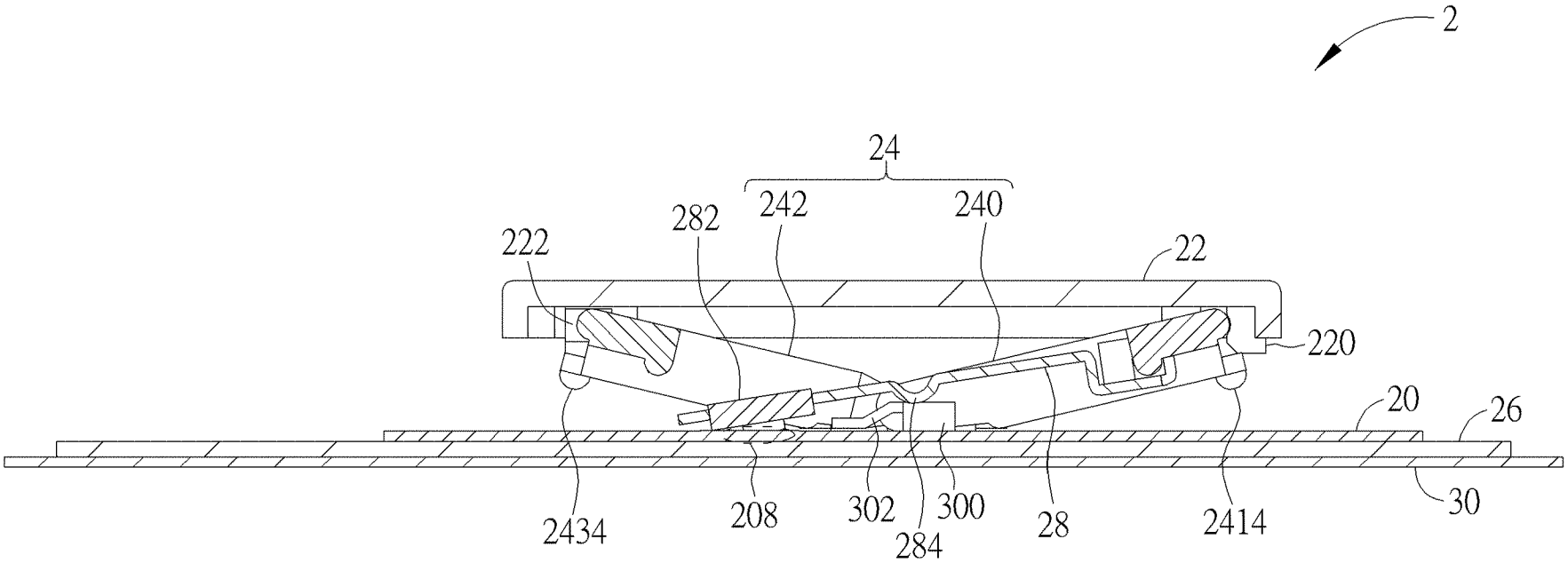
FIG. 7 is a sectional view of the keyswitch along the line X-X in FIG. 2.
Figure 9:
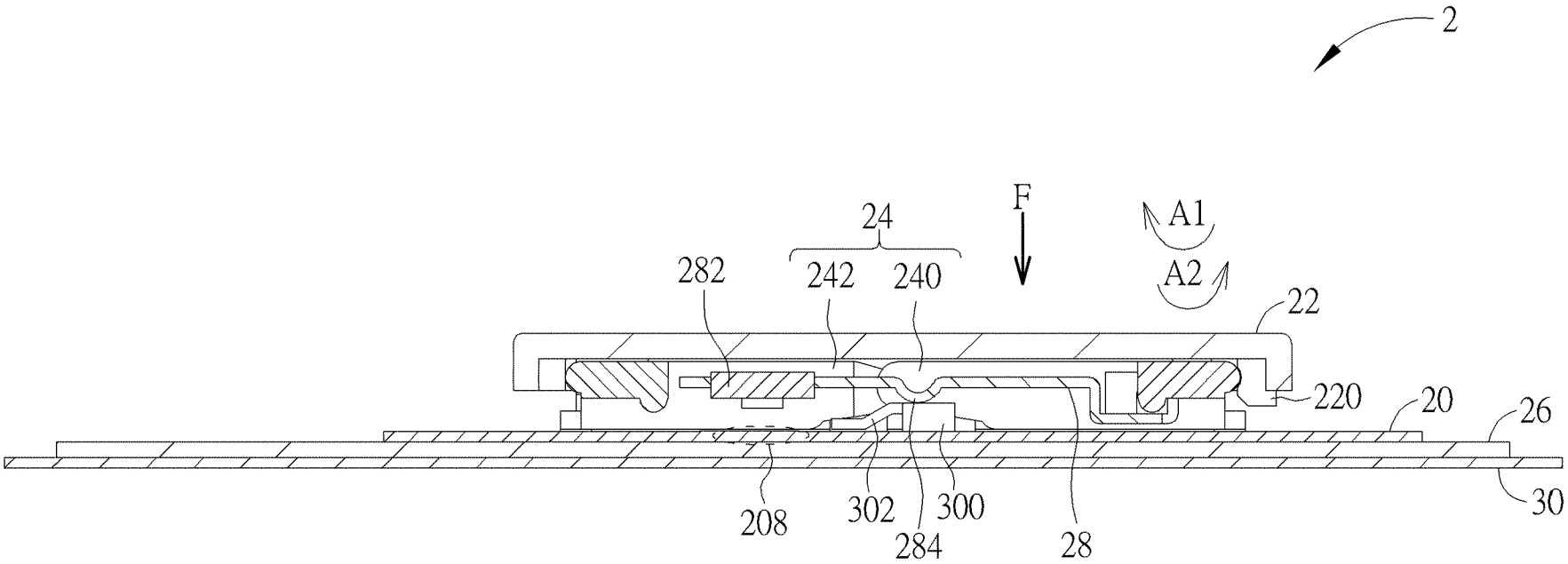
FIG. 9 is a sectional view of the keyswitch in FIG. 7 when the keycap is pressed.
Figure 11:
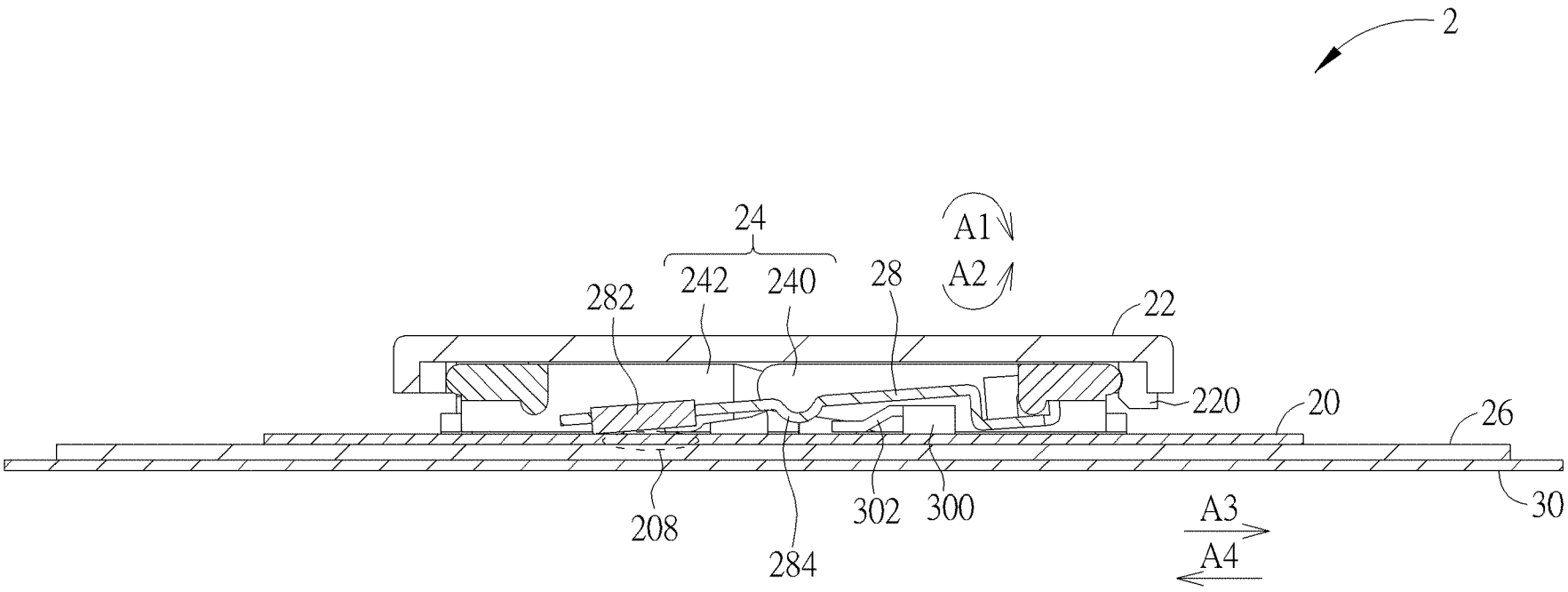
FIG. 11 is a sectional view of the keyswitch in FIG. 7 when a second base plate thereof is moved to a storage position.

Furthermore, the support 240 has a pivotal connection portion 2404, a pivotal connection hole 2406, and a limitation portion 2408 at the ends of the two arm sections thereof. The support 242 has a pivotal connection portion 2424, a pivotal connection hole 2426, and a limitation portion 2428 at the ends of the two arm sections thereof. The pivotal connection portion 2404 of the support 240 is inserted into the pivotal connection hole 2426 of the support 242, and the pivotal connection portion 242 of the support 242 is inserted into the pivotal connection hole 2406 of the support 240, so that the support 240 and the support 242 connect with each other. After the supporting device 24 is assembled to and between the keycap 22 and the first base plate 20, the limitation portion 2408 of the support 240 is located in a limitation slot 204 of the first base plate 20, and the limitation portion 2428 of the support 242 is located in a limitation slot 206 of the first base plate 20. Therein, the limitation slots 204 and 206 are formed on the connection sockets 200 and 202. In the embodiment, the connection sockets 200 and 202 are formed by stamping and bending a portion of the first base plate 20; therein, the limitation slots 204 and 206 can be a T-shaped slot hole. Thereby, the keycap 22 can move between an upward position (as shown by FIG. 7) and a downward position (as shown by FIG. 9 and FIG. 11) through the supporting device 24.

The bracket 28 is movably disposed between the keycap 22 and the first base plate 20. In the embodiment, the bracket 28 is a sheet part formed by bending a metal plate or injecting plastics. An end of the bracket 28 is pivotally connected to the support 240. The bracket 28 has a retaining slot 280 at each of two opposite sides of a pivotal connection section of the bracket 28 pivotally connected to the support 240. The retaining slot 280 has a holding space and is formed by an end wall and a hooked side wall of the bracket 28 at the pivotal connection section. The pivotal connection section can be lower than the main portion of the bracket 28 and is bent downward at the side opposite to the side walls, so that the end walls and the side walls will not structurally interfere with the keycap 22 when the keyswitch 2 is in use or in storage, which is also conducive to a reduction in the whole height of the keyswitch 2 when in use or in storage. The support 240 has a shaft portion 2410 parallel to the horizontal section. The supports 240 and 242 have accommodating recesses 2412 and 2432 respectively, each of which is the internal space defined by the horizontal section and the two arm sections. The shaft portion 2410 of the support 240 fits in the retaining slots 280, so that the bracket 28 is pivotally connected to the shaft portion 2410 of the support 240. After the supporting device 24 and the bracket 28 are assembled, the bracket 28 is accommodated in the accommodating recess 2412 of the support 240 and the accommodating recess 2432 of the support 242. Thereby, the bracket 28 is rotatably connected to the supporting device 24. It is noted that, in an instance, the bracket 28 can be slidably connected to the supporting device 24, which depends on actual applications. Furthermore, in another instance, the bracket 28 can be rotatably or slidably connected to the keycap 22, which depends on actual applications. Moreover, the length and shape of the bracket 28 also depends on actual applications, not limited to the embodiment shown by the figures.

Figure 12:
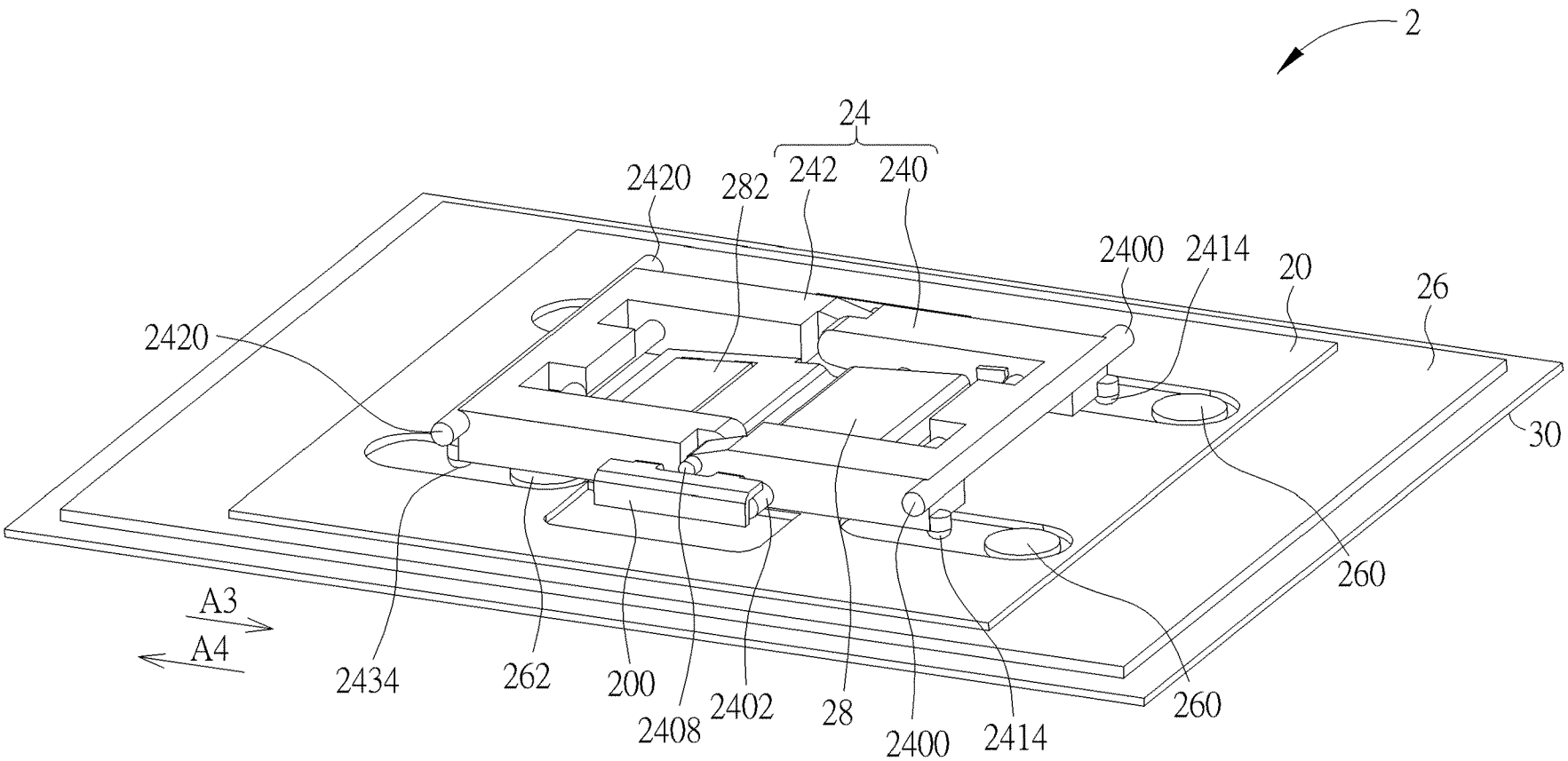
FIG. 12 is a schematic diagram illustrating the keyswitch in FIG. 11 without the keycap.
Figure 13:
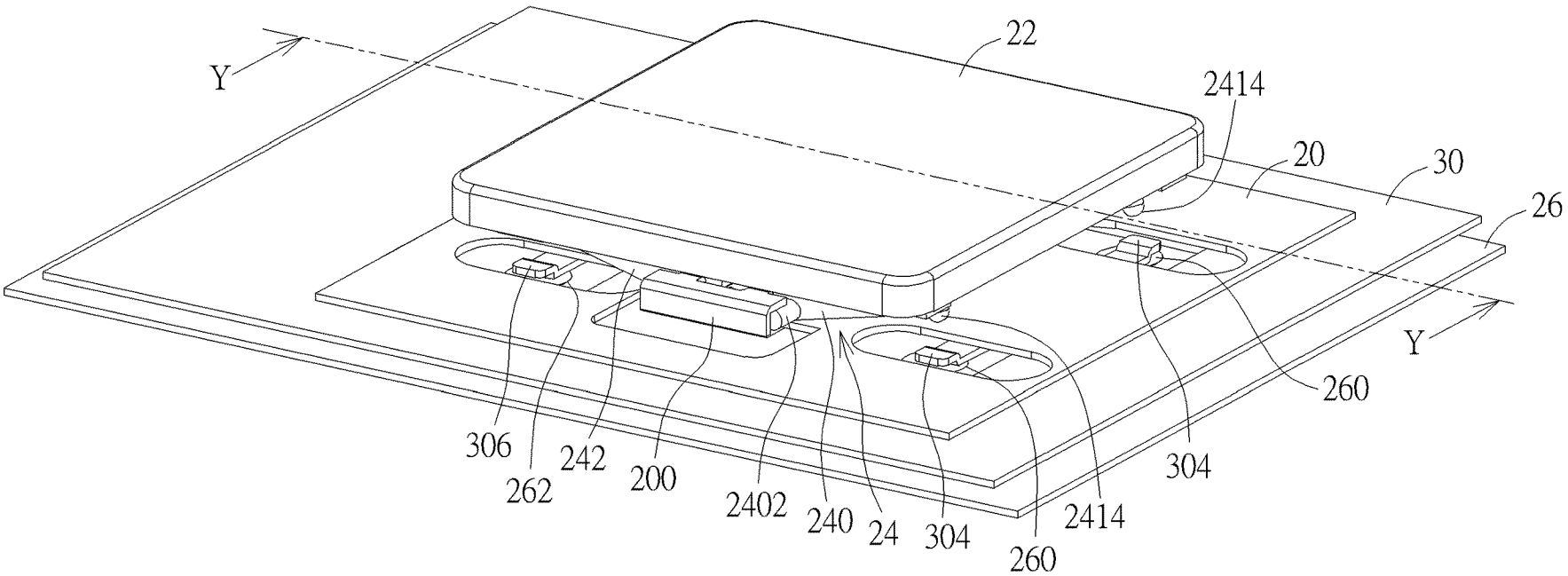
FIG. 13 is a schematic diagram illustrating a keyswitch of another embodiment according to the invention.
Figure 14:
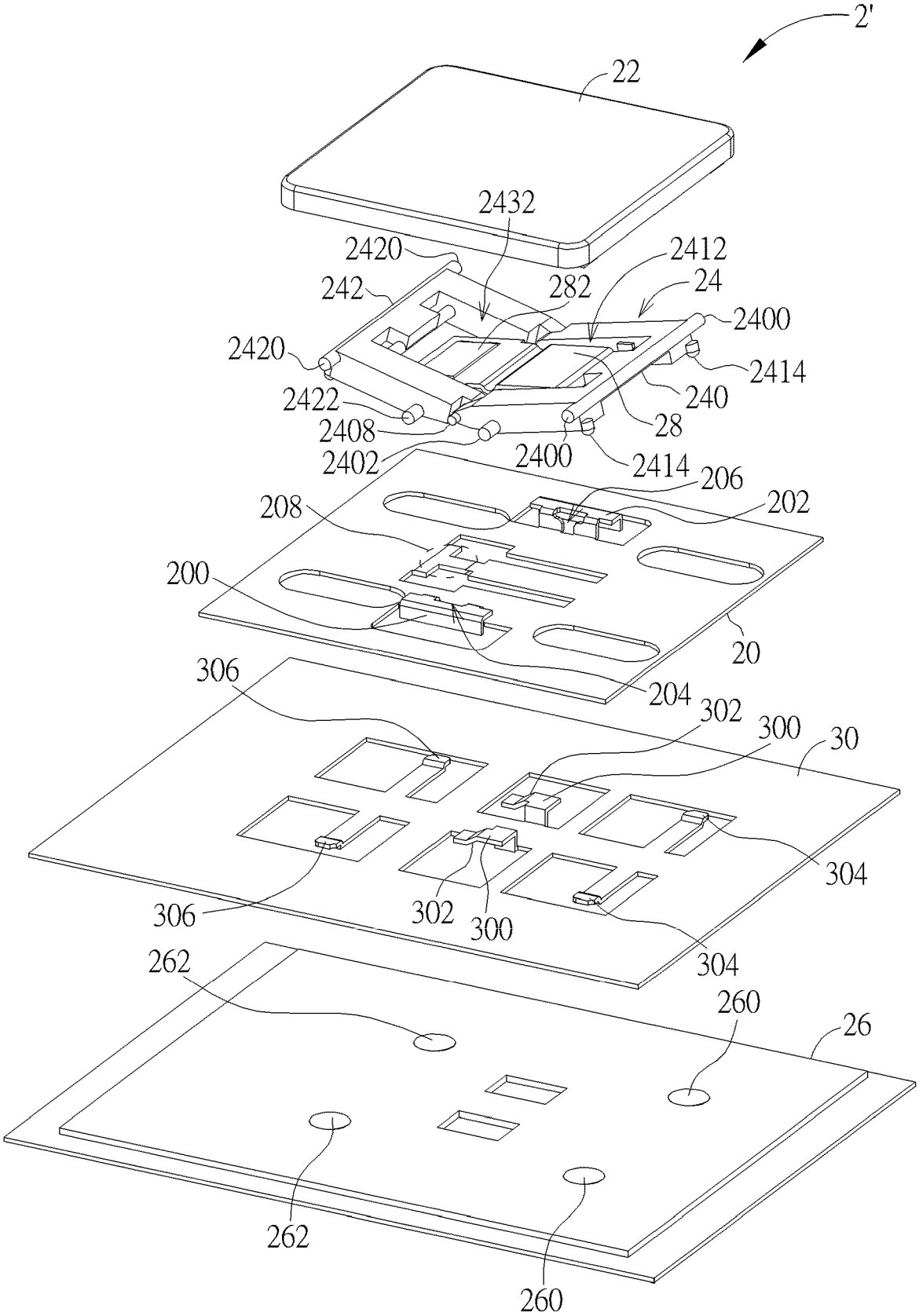
FIG. 14 is an exploded view of the keyswitch in FIG. 13.

The second base plate 30 is disposed opposite to the first base plate 20. In the embodiment, the second base plate 30 is disposed under the first base plate 20. The second base plate 30 can move between an operation position (shown by FIG. 7 to FIG. 10) and a storage position (as shown by FIG. 11 and FIG. 12). Furthermore, the circuit board 26 is disposed above the second base plate 30, so that the circuit board 26 can move along with the second base plate 30 between the operation position and the storage position.

Figure 6:
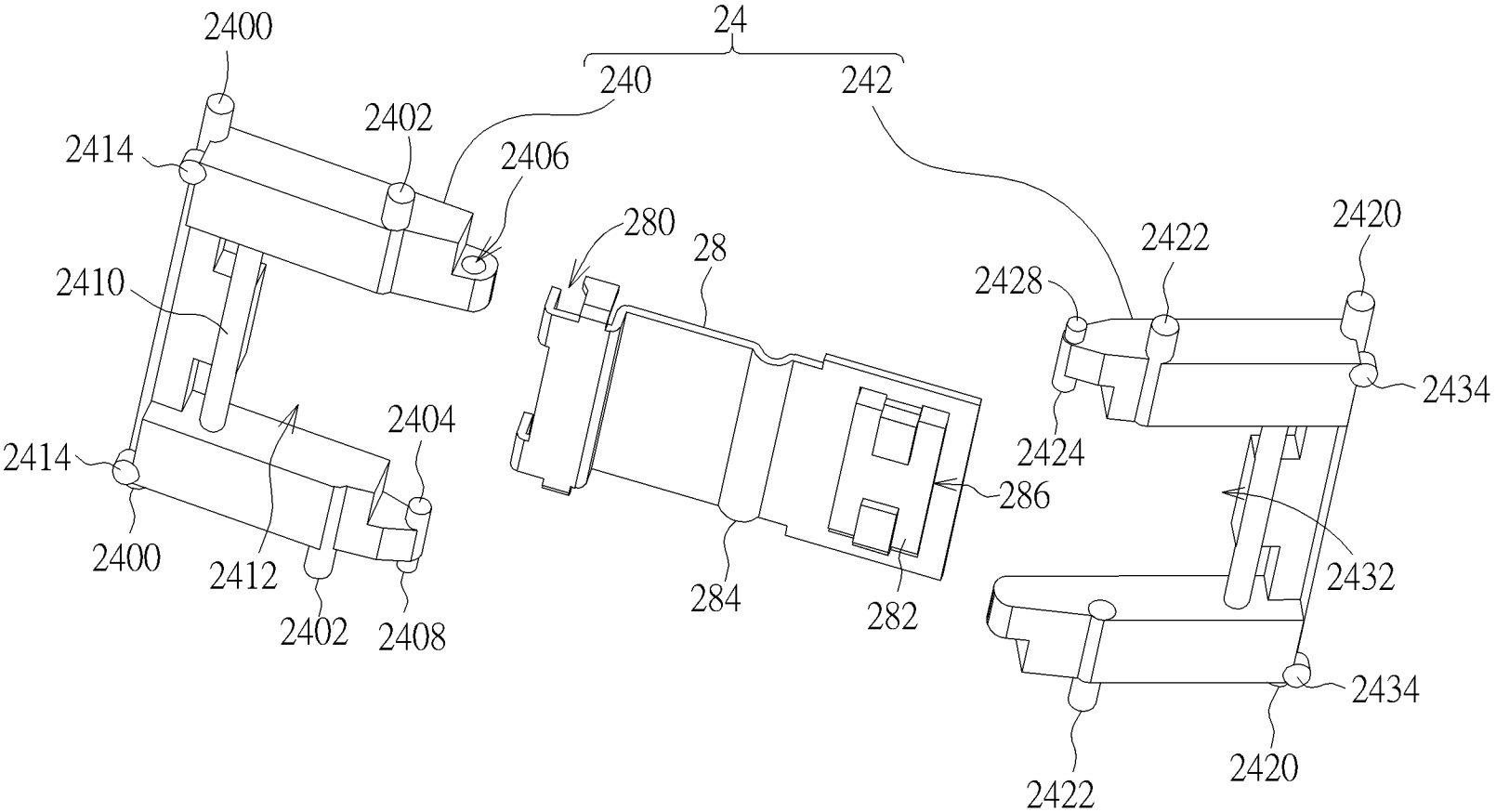
FIG. 6 is an exploded view of the supporting device and the bracket of the keyswitch in FIG. 3 in another view point.

The first base plate 20 has a first magnetic area 208. The bracket 28 has a second magnetic area 282. After the bracket 28 is assembly between the keycap 22 and the first base plate 20 through the supporting device 24, the second magnetic area 282 is opposite to the first magnetic area 208. One of the first magnetic area 208 and the second magnetic area 282 can be a magnetic part (e.g. magnet); the other of the first magnetic area 208 and the second magnetic area 282 can be a magnetic part (e.g. magnet) or a part made of a paramagnetic material (e.g. iron or other metals). In the embodiment, the first magnetic area 208 can be made of a paramagnetic material; the second magnetic area 282 can be a magnetic part. In practice, the first base plate 20 can be totally made of a paramagnetic material, or only the first magnetic area 208 is made of a paramagnetic material. In an instance, the first magnetic area 208 and the second magnetic area 282 can be magnetic parts. In the embodiment, the bracket 28 has an accommodating recess 286 at a magnetic attraction section thereof relative to the pivotal connection section, so as to accommodate the second magnetic area 282 therein. The accommodating recess 286 can be realized by an accommodating space formed by a strip portion that is located between two parallel slots formed at the magnetic attraction section of the bracket 28 and is bent downward. In FIG. 6, the strip portion under the second magnetic area 282 is further cut into two separate tabs. Furthermore, the second magnetic area 282 is exposed through the accommodating recess 286 for directly touching the first base plate 20 and magnetically attracting the first magnetic area 208. It is noted that if the second magnetic area 282 can directly magnetically attract the first magnetic area 208 of the first base plate 20, then the bracket 28 can be made of a non-metallic material. In an instance, the second magnetic area 282 can be directly joined to a bottom surface of the bracket 28, which depends on actual applications.

The second base plate 30 has a supporting portion 300 and a slanting portion 302. Therein, the slanting portion 302 is connected to the supporting portion 300. The supporting portion 300 is higher than the slanting portion 302. The first base plate 20 and the circuit board 26 have openings respectively corresponding to the supporting portion 300 and the slanting portion 302. During the assembly of the keyswitch 2, the supporting portion 300 and the slanting portion 302 of the second base plate 30 pass upward through the circuit board 26 and the first base plate 20. No matter when the keyswitch 2 is under operation or in storage, the supporting portion 300 and the slanting portion 302 are located between a top surface of the second base plate 30 and the bracket 28. In the embodiment, the supporting portion 300 and the slanting portion 302 can be a slanting surface-flat surface continuous structure above the top surface of the second base plate 30 by a certain distance which is formed by stamping and bending a portion of the second base plate 30. Furthermore, in the embodiment, there are two supporting portion 300*s* and two slanting portions 302 symmetrically disposed on the second base plate 30; however, it is not limited thereto in practice. As shown by FIG. 7, when the second base plate 30 is located at the operation position, a bottom surface of the bracket 28 abuts against the supporting portion 300 of the second base plate 30, and a magnetic attraction force between the second magnetic area 282 at the magnetic attraction section of the bracket 28 and the first magnetic area 208 of the first base plate 20 keeps the keycap 22 at the upward position. In the embodiment, the bracket 28 has a protrusion 284 protruding toward the first base plate 20. The pivotal connection section and the magnetic attraction section of the bracket 28 are located at two sides of the protrusion 284 (or the portion of the bracket 28 that abuts against the supporting portion 300 of the second base plate 30). In the embodiment, the pivotal connection section and the retaining slot 280 of the bracket 28 are located in the accommodating recess 2412 of the support 240, and the magnetic attraction section and the second magnetic area 282 of the bracket 28 are located in the accommodating recess 2432 of the support 242; however, it is not limited thereto in practice. For example, if the whole length of the bracket 28 is shortened to be a half of the original length, the pivotal connection section/the retaining slot 280, the protrusion 284, and the magnetic attraction section/the second magnetic area 282 of the bracket 28 all can be located in the accommodating recess 2412 of the support 240, as long as the supporting portion 300 and the slanting portion 302 of the second base plate 30 are also disposed at the corresponding position under the support 242 where it is convenient for the supporting portion 300 and the slanting portion 302 to lift the support 242. When the second base plate 30 is located at the operation position, the protrusion 284 of the bracket 28 abuts against the supporting portion 300 of the second base plate 30. However, in an instance, the bracket can be provided without the protrusion 284; therein, it is practicable to increase the height of the supporting portion 300 and the slanting portion 302 of the second base plate 30 so that the bracket 28 can directly abut against the supporting portion 300 of the second base plate 30. In the embodiment, the protrusion 284 can be formed by stamping or bending a portion of the bracket 28. The top surface of the protrusion 284 shows a concave groove; the bottom surface of the protrusion 284 shows a half cylinder. In an instance, the protrusion 284 can be a solid rib on the bracket 28.

Figure 8:
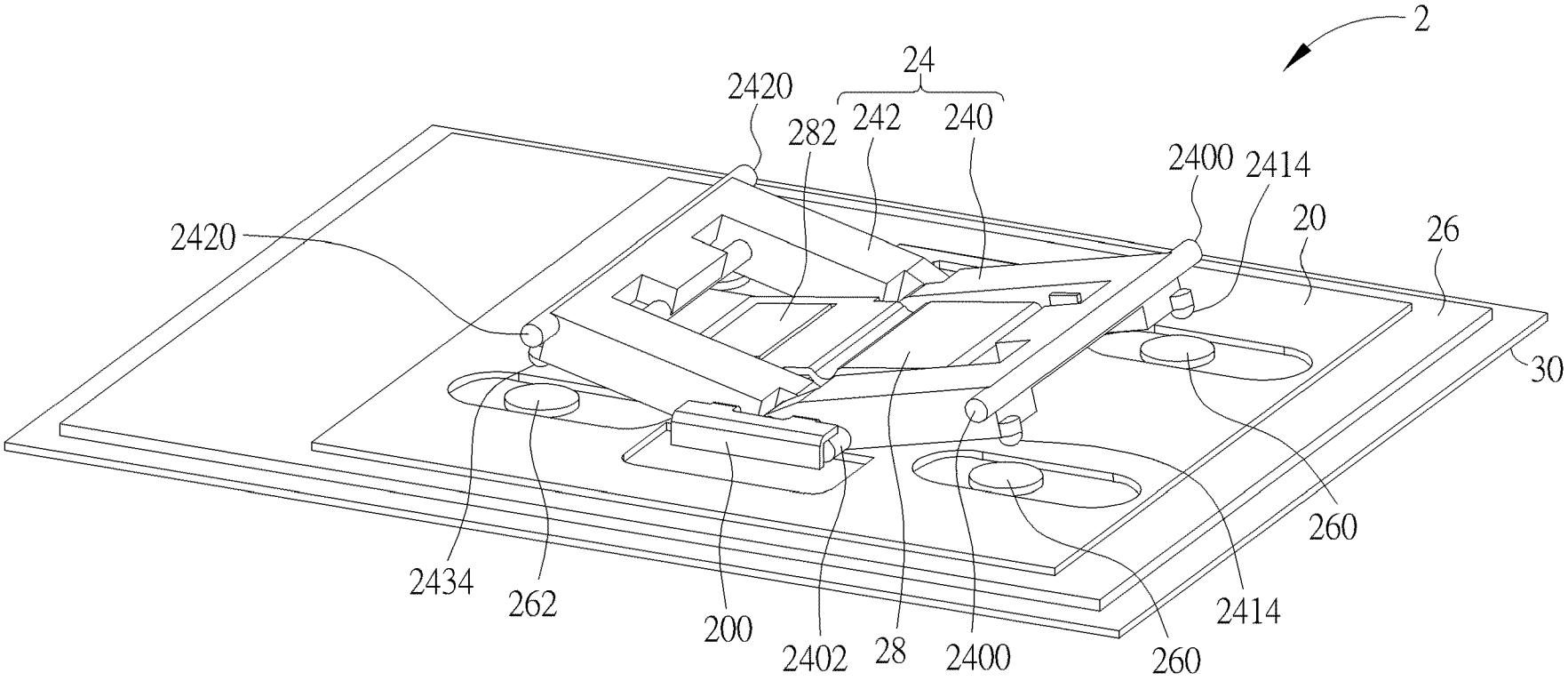
FIG. 8 is a schematic diagram illustrating the keyswitch in FIG. 7 without its keycap.

As shown by FIG. 8, the support 240 of the supporting device 24 has a trigger portion 2414. The support 242 of the supporting device 24 has a trigger portion 2434. Furthermore, the circuit board 26 has a switch 260 corresponding to the trigger portion 2414, and a switch 262 corresponding to the trigger portion 2434. When the second base plate 30 is located at the operation position, the switches 260 and 262 are disposed opposite to the trigger portions 2414 and 2434 respectively. In the embodiment, there are two trigger portions 2414 symmetrically disposed on the support 240, and two trigger portions 2434 symmetrically disposed on the support 242; there are four switches 260 and 262 on the circuit board 26 corresponding to the two trigger portions 2414 and the two trigger portions 2434. In the embodiment, the first base plate 20 has openings corresponding to the switches 260 and 262 of the circuit board, so that the trigger portion 2414 of the support 240 of the supporting device 24 and the trigger portion 2434 of the support 242 of the supporting device 24 can directly touch the switches 260 and 262.

Figure 10:
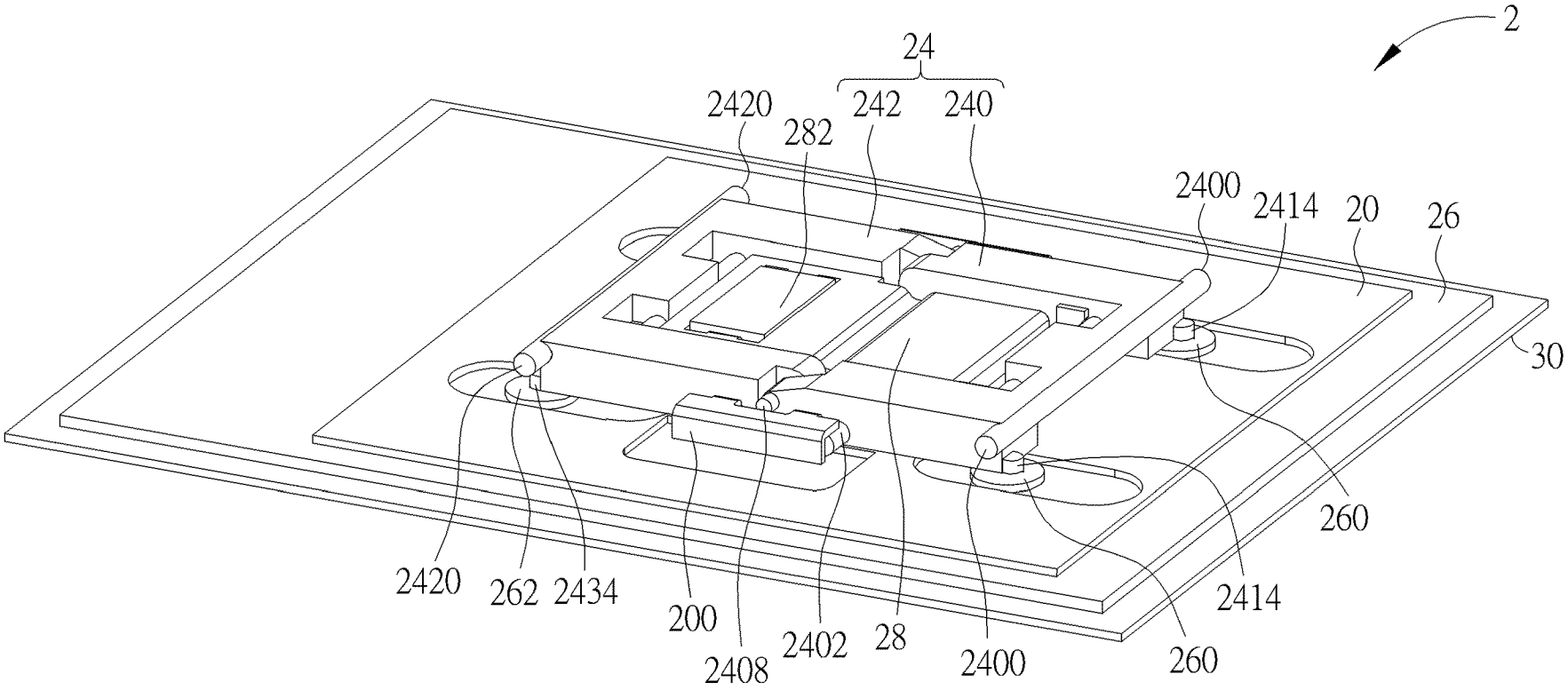
FIG. 10 is a schematic diagram illustrating the keyswitch in FIG. 9 without the keycap.

As shown by FIG. 9, when the second base plate 30 is located at the operation position and the keycap 22 is pressed by an external force F, because the pivotal connection section of the bracket 28 is pivotally connected to the shaft portion 2410 of the support 240 of the supporting device 24, the supporting device 24 will drive the bracket 28 to move on the supporting portion 300 as a fulcrum (i.e. the bracket 28 pivots about the supporting portion 300 in a direction A1) to move the second magnetic area 282 at the magnetic attraction section of the bracket 28 upward away from the first magnetic area 208. When the keycap 22 is pressed by the external force F so that the second magnetic area 282 is away from the first magnetic area 208, the keycap 22 is moved from the upward position to the downward position through the supporting device 24. In the meanwhile, as shown by FIG. 10, the trigger portion 2414 of the support 240 and the trigger portion 2434 of the support 242 will trigger the switches 260 and 262 on the circuit board 26 for executing a corresponding input function.

In the embodiment, when the keycap 22 is located at the downward position, the support 240 and the support 242 tends to be disposed horizontally, and the positions of the connection portions 2400, 2402, 2420 and 2422 are higher than the shaft portion 2410 of the support 240 and the retaining slot 280 of the bracket 28. Furthermore, the depths of the retaining slot 280, the protrusion 284, and the accommodating recess 286 of the bracket 28 are less than the distance from a bottom surface of the keycap 22 to a top surface of the first base plate 20, by which the bracket 28 will not structurally interfere with the keycap 22 and the first base plate 20 when the keycap 22 moves between the upward position and the downward position through the supporting device 24.

When the external force F is removed from the keycap 22, the first magnetic area 208 and the second magnetic area 282 magnetically attract each other. In the meanwhile, the second magnetic area 282 will drive the bracket 28 to move on the supporting portion 300 as a fulcrum (i.e. the bracket 28 pivots about the supporting portion 300 in a direction A2), so that the second magnetic area 282 at the magnetic attraction section of the bracket 28 moves downward to approach the first magnetic area 208, and the pivotal connection section of the bracket 28 pushes upward the support 240 to drive the whole supporting device 24. When the magnetic attraction force makes the second magnetic area 282 approach the first magnetic area 208, the keycap 22 will be moved from the downward position to the upward position through the supporting device 24.

When a keyboard with the keyswitch 2 is not in use, a user can move the second base plate 30 from the operation position (as shown by FIG. 7 and FIG. 8) to the storage position (as shown by FIG. 11 and FIG. 12) in a direction A3, so as to reduce the height of the keyswitch 2 for convenience of the storage of the keyboard. As shown by FIG. 11, when the second base plate 30 is located at the storage position, the protrusion 284 of the bracket 28 is separated from the supporting portion 300 of the second base plate 30. Because the supporting portion 300 of the second base plate 30 no longer supports the bracket 28, the magnetic attraction force between the second magnetic area 282 and the first magnetic area 208 will make the bracket 28 rotate relative to the second base plate 30 in the direction A1, so that the keycap 22 moves from the upward position to the downward position through the supporting device 24. In the meanwhile, the magnetic attraction force between the second magnetic area 282 and the first magnetic area 208 can keep the keycap 22 at the downward position.

Furthermore, when the keyswitch 2 is in storage (i.e. the second base plate 30 is moved from the operation position to the storage position in the direction A3), the circuit board 26 moves along with the second base plate 30 in the direction indicated by the arrow A3, so that the switches 260 and 262 and the trigger portions 2414 and 2434 of the supports 240 and 242 are staggered. Therefore, when the second base plate 30 is located at the storage position so that the keycap 22 is kept at the downward position, the trigger portions 2414 and 2434 of the supports 240 and 242 will not trigger the switches 260 and 262 of the circuit board 26.

When the user wants to use the keyboard with the keyswitch 2, the user can move the second base plate 30 from the storage position (as shown by FIG. 11 and FIG. 12) to the operation position (as shown by FIG. 7 and FIG. 8) in a direction A4. When the second base plate 30 moves from the storage position to the operation position in the direction A4, the slanting portion 302 of the second base plate 30 will push against the protrusion 284 of the bracket 28 to lift the bracket 28, so that the protrusion 284 of the bracket 28 abuts against the supporting portion 300 of the second base plate 30. In the meanwhile, the bracket 28 will rotate in the direction A2 relative to the second base plate 30, so that the keycap 22 moves from the downward position to the upward position through the supporting device 24. When the keycap 22 is located at the upward position and the second base plate 30 is located at the operation position, the use can press the keycap 22 for executing a corresponding input function.

In another embodiment, the supporting portion 300 of the second base plate 30 indirectly supports, not directly abuts against the protrusion 284 of the bracket 28. The first base plate 20 has a slight protrusion 210 (shown in dashed lines in FIG. 3 for example) under the protrusion 284. The slight protrusion 210 shows a triangle for example and has a vertex edge protruding toward the bracket 28, and a bottom edge toward the second base plate 30. When the second base plate 30 is located at the storage position, the height of the slight protrusion 210 is less than the distance between the protrusion 284 of the bracket 28 and the top surface of the first base plate 20. When the second base plate 30 is located at the operation position (as shown by FIG. 7 and FIG. 8), the supporting portion 300 of the second base plate 30 can lift the slight protrusion 210 of the first base plate 20 (e.g. by directly pushing against the slight protrusion 210, or pushing against a portion of the first base plate 20 close to the slight protrusion 210) so that the bracket 28 abuts against the slight protrusion 210, and the magnetic attraction force between the second magnetic area 282 and the first magnetic area 208 keeps the keycap 22 at the upward position. In the meanwhile, the area of the first base plate 20 close to the slight protrusion may slightly rise. When the second base plate 30 is located at the storage position (as shown by FIG. 11 and FIG. 12), the supporting portion 300 of the second base plate 30 and the slight protrusion of the first base plate 20 are staggered so that the slight protrusion is away from the bracket 28 and the magnetic attraction force keeps the keycap 22 at the downward position.

Figure 17:
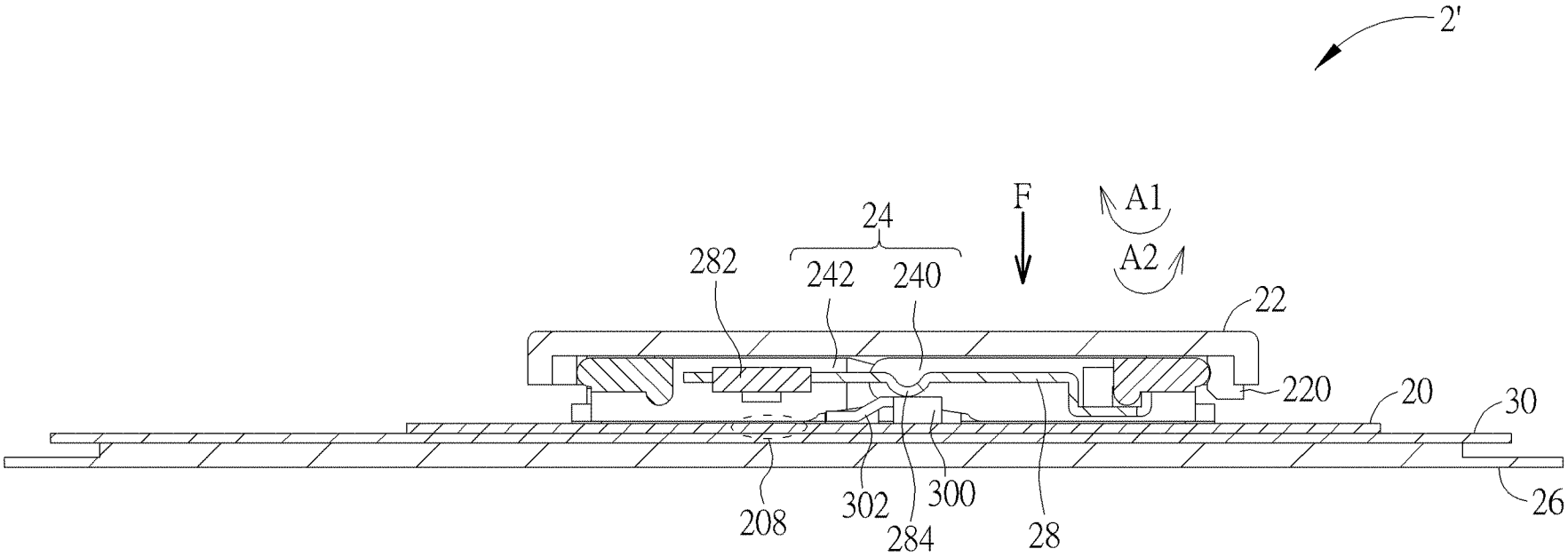
FIG. 17 is a sectional view of the keyswitch in FIG. 15 when the keycap is pressed.
Figure 18:
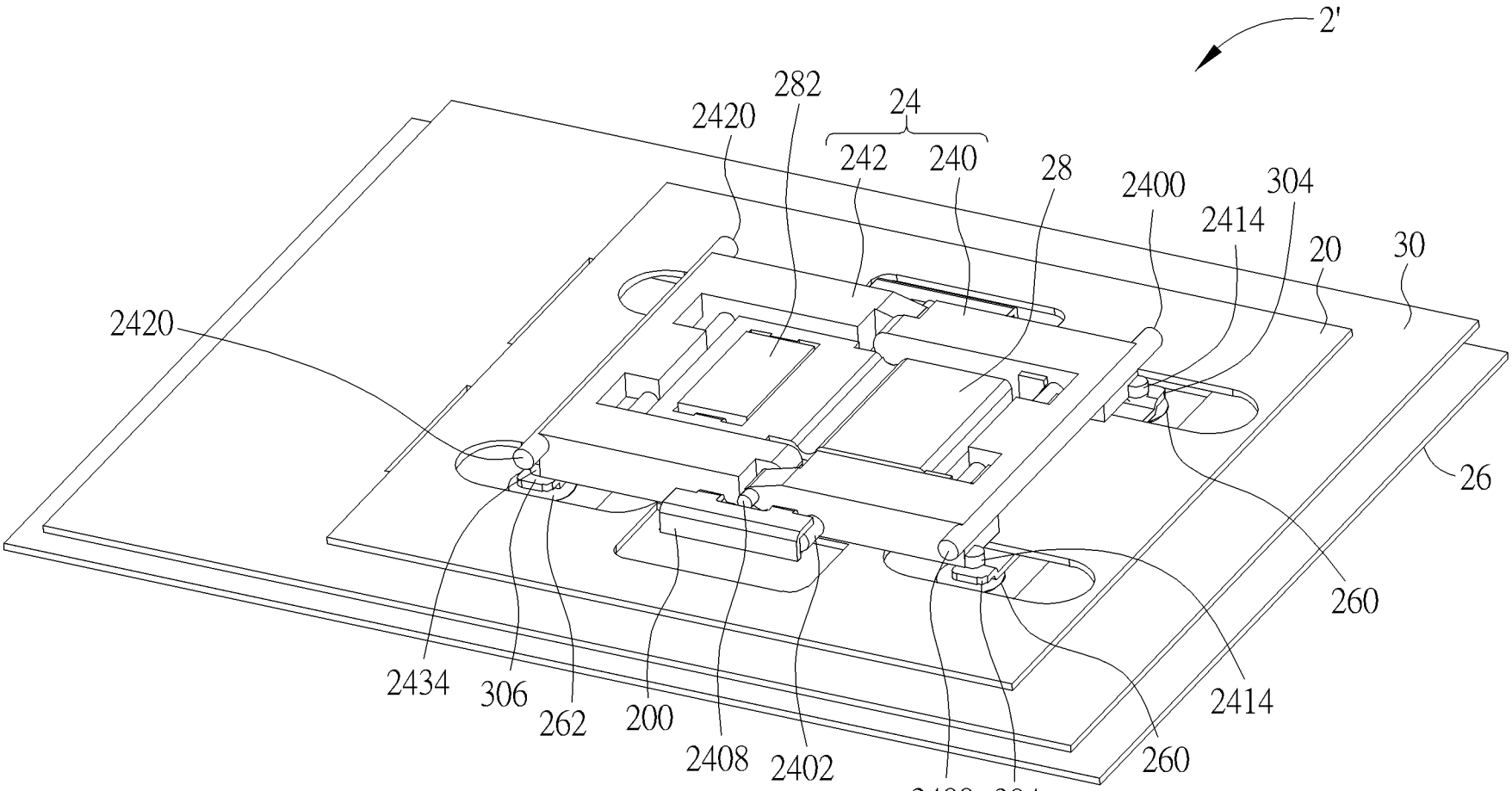
FIG. 18 is a schematic diagram illustrating the keyswitch in FIG. 17 without the keycap.
Figure 19:
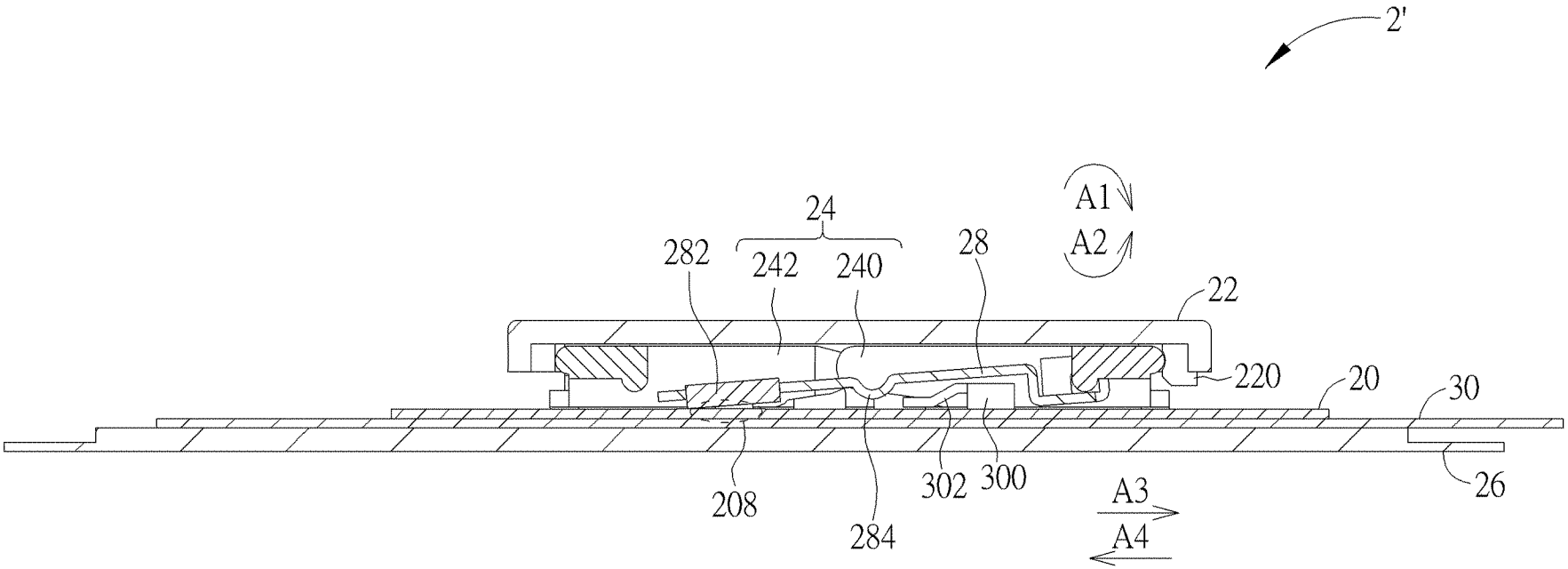
FIG. 19 is a sectional view of the keyswitch in FIG. 15 when a second base plate thereof is moved to a storage position.
Figure 20:
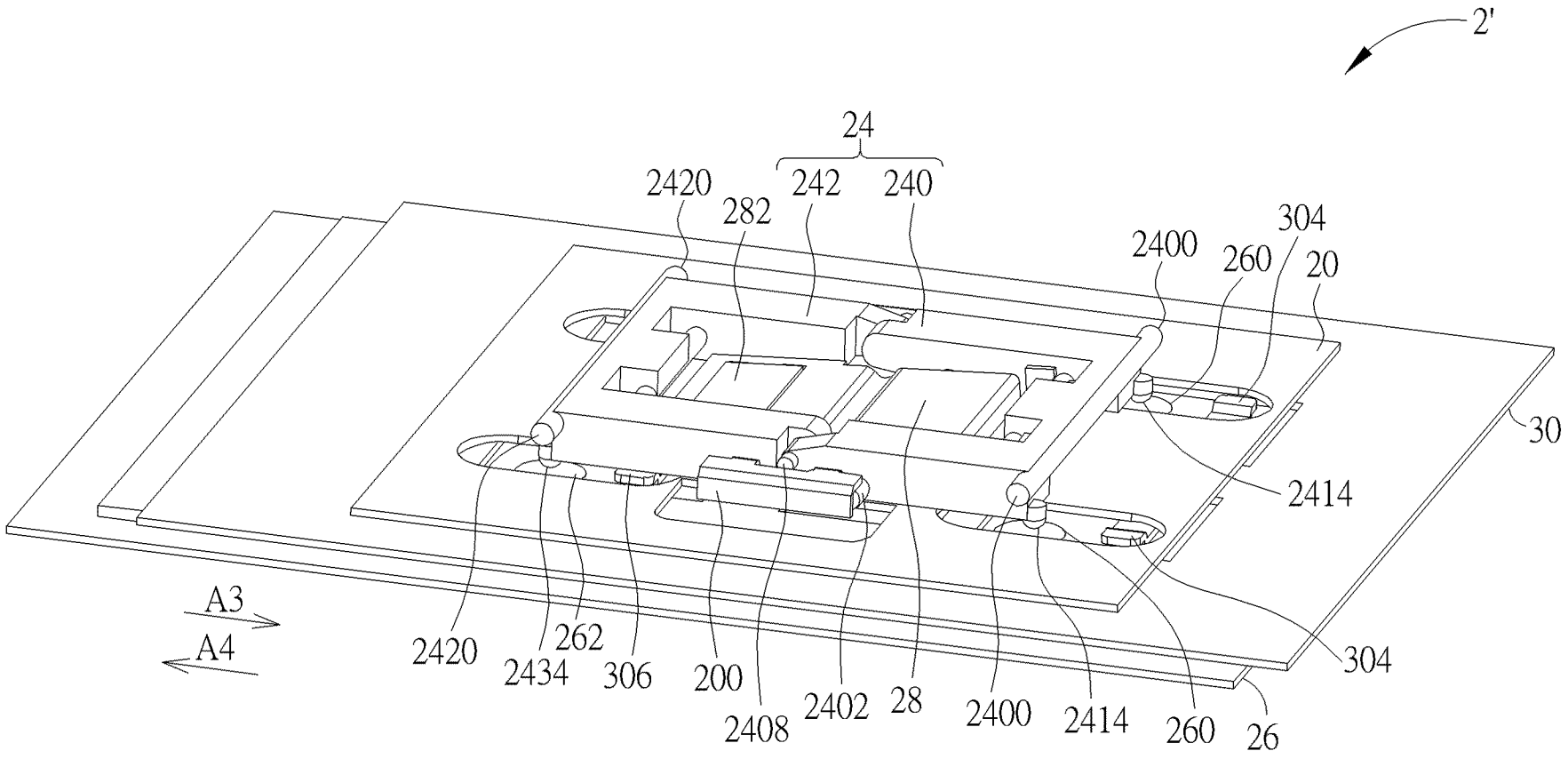
FIG. 20 is a schematic diagram illustrating the keyswitch in FIG. 19 without the keycap.
Figure 21:
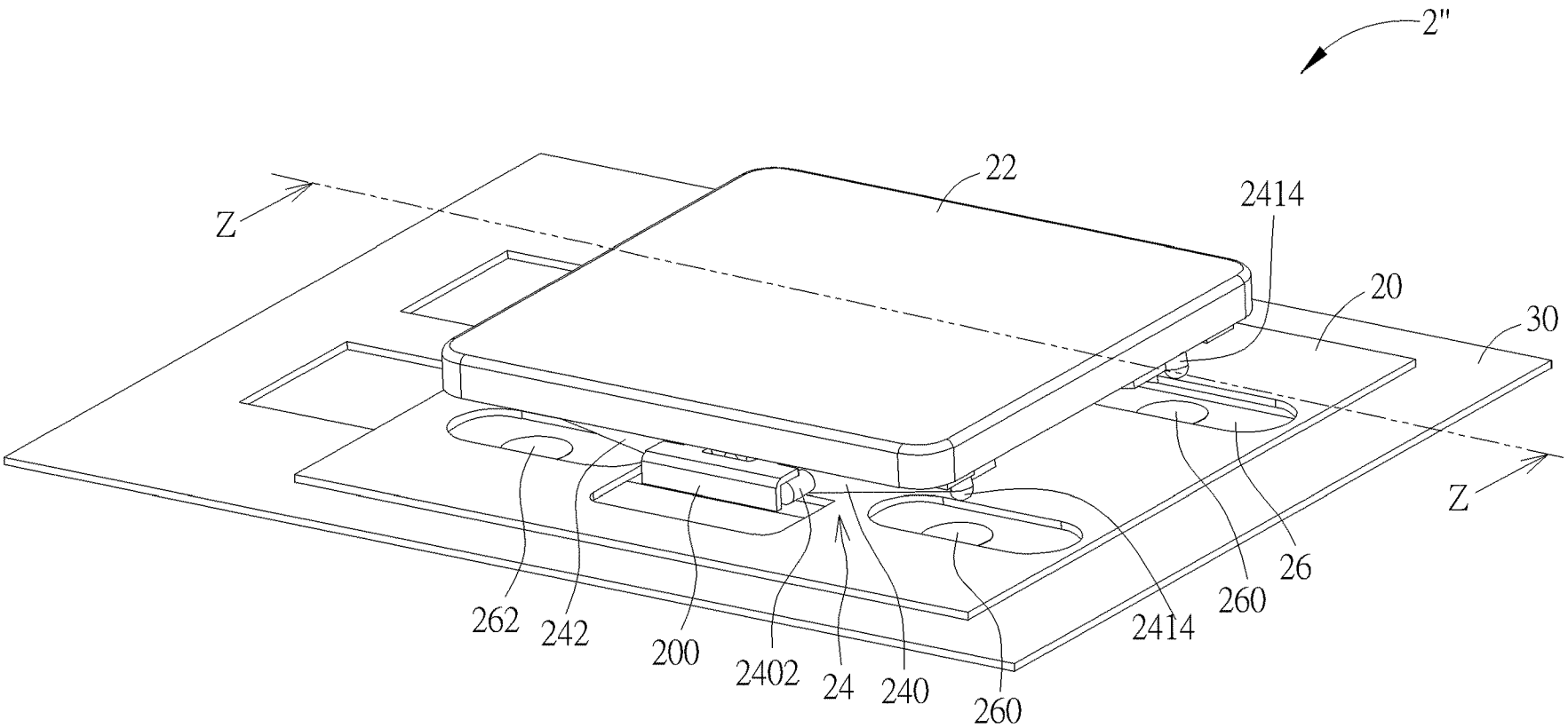
FIG. 21 is a schematic diagram illustrating a keyswitch of another embodiment according to the invention.
Figure 22:
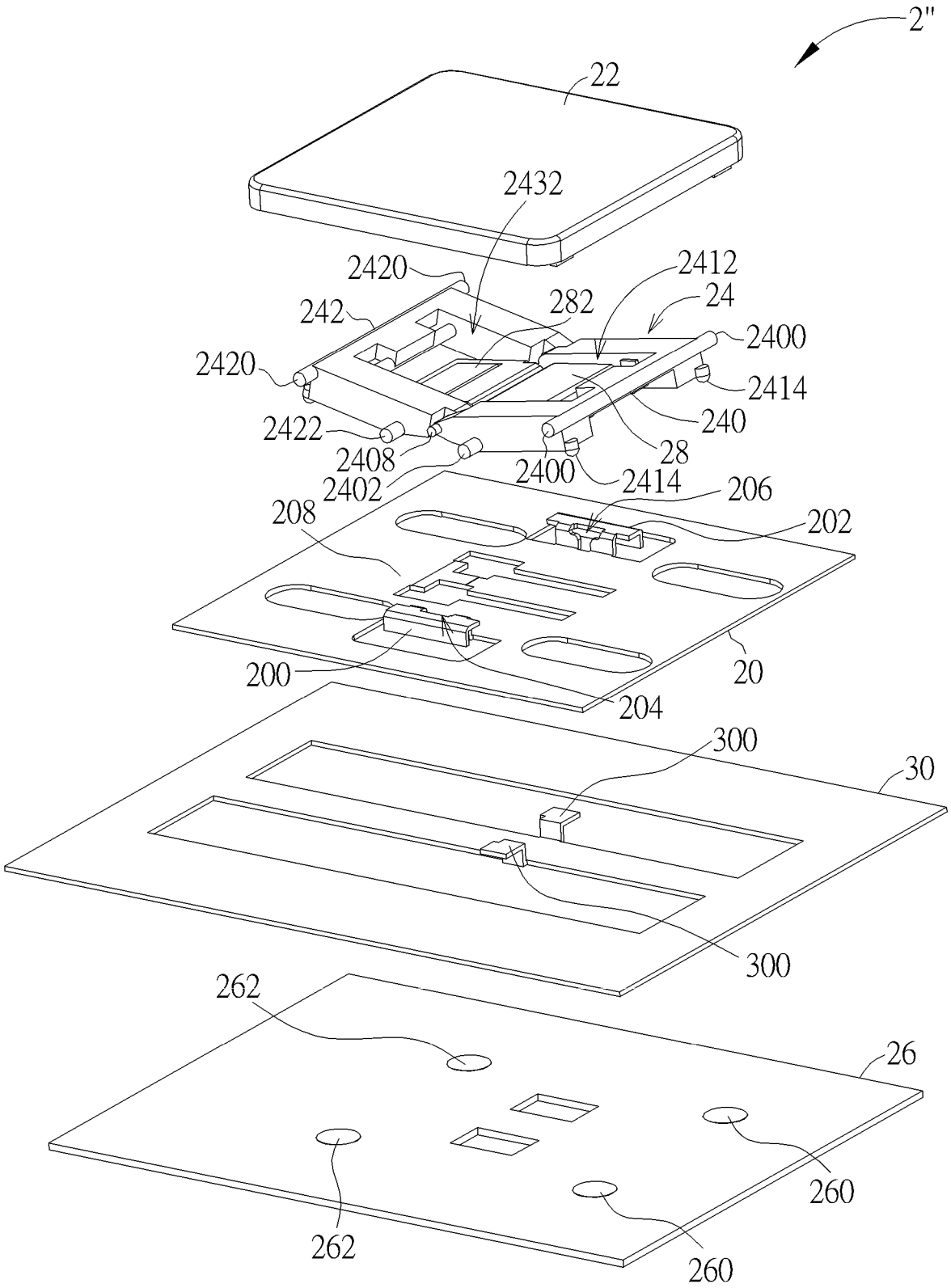
FIG. 22 is an exploded view of the keyswitch in FIG. 21.

Please refer to FIG. 13 to FIG. 20. A keyswitch 2' of another embodiment according to the invention includes a first base plate 20, a keycap 22, a supporting device 24, a circuit board 26, a bracket 28, and a second base plate 30. A difference between the keyswitch 2' and the above-mentioned keyswitch 2 is that the circuit board 26 of the keyswitch 2' is disposed under the second base plate 30. Therefore, the circuit board 26 of the keyswitch 2' will not move along with the second base plate 30 between the operation position (as shown by FIG. 15 to FIG. 18) and the storage position (as shown by FIG. 19 and FIG. 20).

In the embodiment, the second base plate 30 has a linkage portion 304 corresponding to the trigger portion 2414, and a linkage portion 306 corresponding to the trigger portion 2434. When the second base plate 30 is located at the operation position, the linkage portion 304 is located between the trigger portion 2414 and the switch 260, and the linkage portion 306 is located between the trigger portion 2434 and the switch 262. In the embodiment, there are four linkage portions 304 and 306 disposed on the second base plate 30 corresponding to two trigger portions 2414 and two trigger portions 2434. In the embodiment, the linkage portions 304 and 306 can be elastic cantilevers formed by stamping a portion of the second base plate 30; however, it is not limited thereto in practice.

Figure 15:
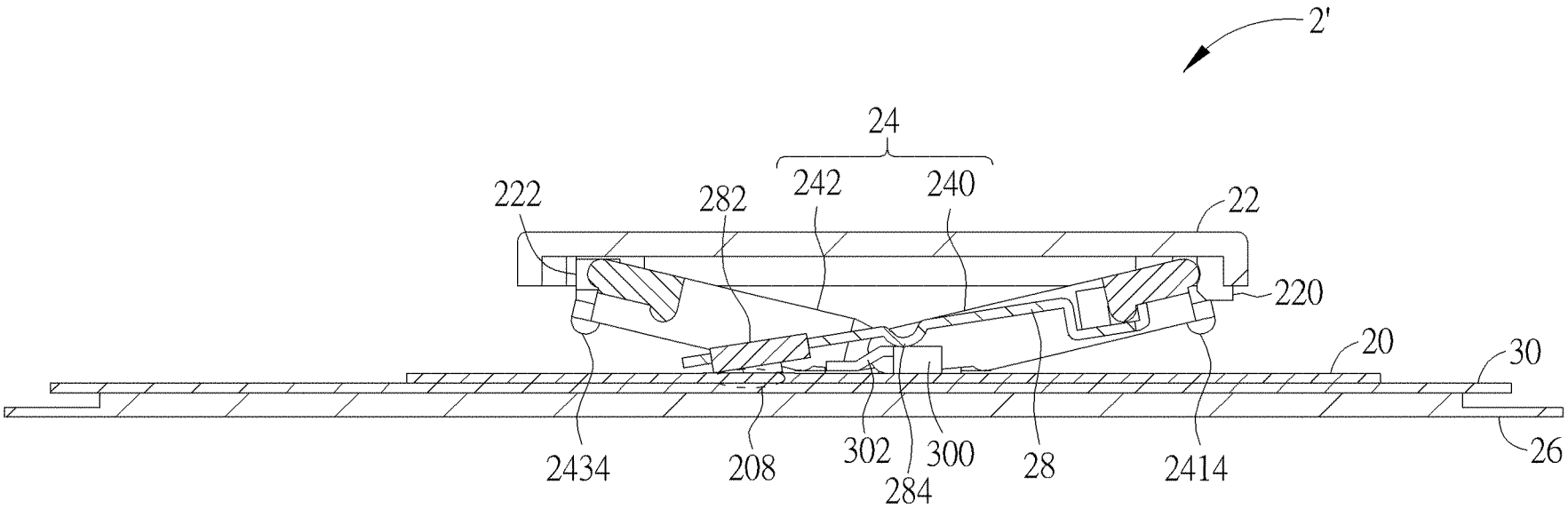
FIG. 15 is a sectional view of the keyswitch along the line Y-Y in FIG. 13.

As shown by FIG. 15, when the second base plate 30 is located at the operation position, the protrusion 284 of the bracket 28 abuts against the supporting portion 300 of the second base plate 30, and the magnetic attraction force between the second magnetic area 282 and the first magnetic area 208 keeps the keycap 22 at the upward position. It is noted that for descriptions about variants of the bracket 28, please refer to the foregoing, which will not be described herein in addition.

As shown by FIG. 17, when the second base plate 30 is located at the operation position and the keycap 22 is pressed by an external force F, the supporting device 24 drives the bracket 28 to move on the supporting portion 300 as fulcrum (i.e. the bracket 28 pivots about the supporting portion 300 in the direction A1) to move the second magnetic area 282 away from the first magnetic area 208. When the keycap 22 is pressed by the external force F so that the second magnetic area 282 is away from the first magnetic area 208, the keycap 22 is moved from the upward position to the downward position through the supporting device 24. In the meanwhile, as shown by FIG. 18, the trigger portion 2414 of the support 240 and the trigger portion 2434 of the support 242 will drive the linkage portions 304 and 306 to trigger the switches 260 and 262 for executing a corresponding input function.

When the external force F is removed from the keycap 22, the first magnetic area 208 and the second magnetic area 282 magnetically attract each other. In the meanwhile, the second magnetic area 282 will drive the bracket 28 to move on the supporting portion 300 as a fulcrum (i.e. the bracket 28 pivots about the supporting portion 300 in the direction A2), so that the second magnetic area 282 approaches the first magnetic area 208 and drives the supporting device 24. When the magnetic attraction force makes the second magnetic area 282 approach the first magnetic area 208, the keycap 22 will be moved from the downward position to the upward position through the supporting device 24.

Figure 16:
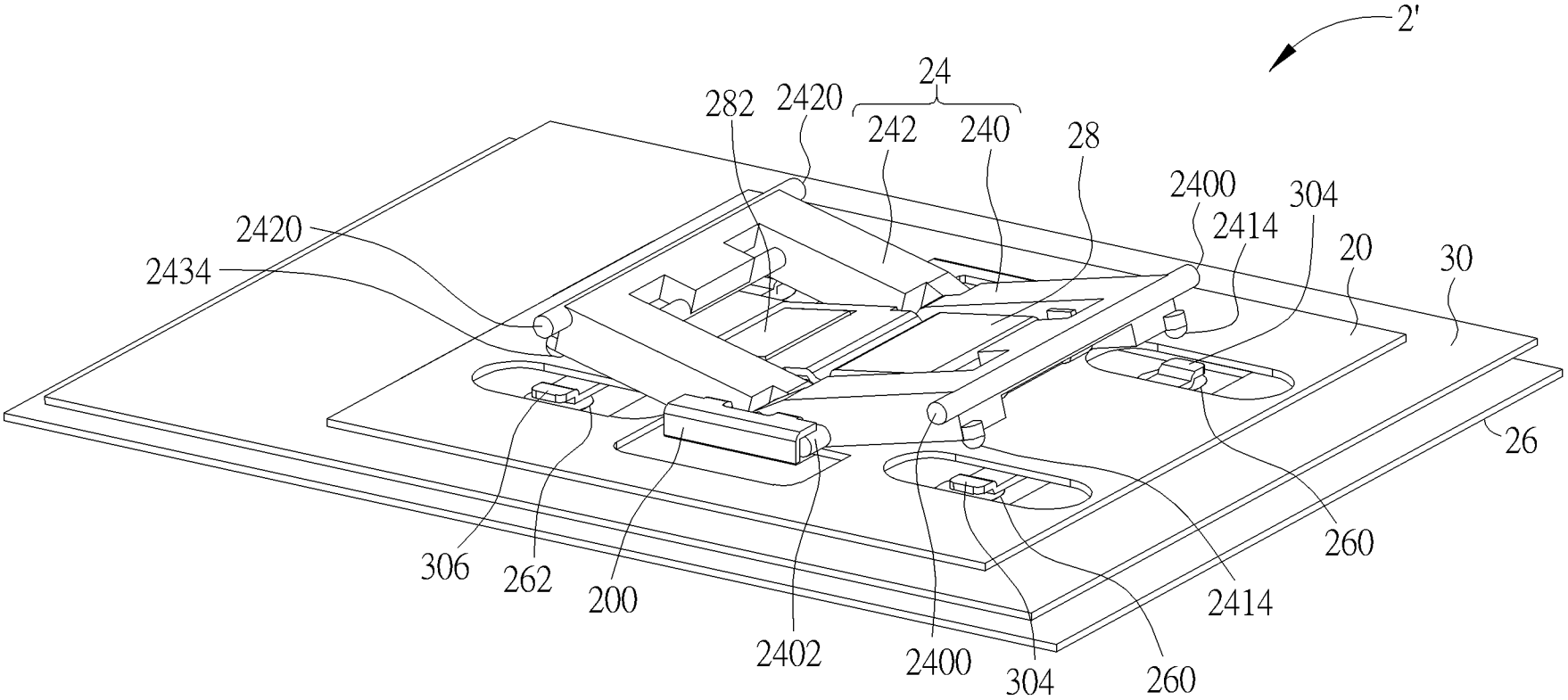
FIG. 16 is a schematic diagram illustrating the keyswitch in FIG. 15 without its keycap.

When a keyboard with the keyswitch 2' is not in use, a user can move the second base plate 30 from the operation position (as shown by FIG. 15 and FIG. 16) to the storage position (as shown by FIG. 19 and FIG. 20) in a direction A3, so as to reduce the height of the keyswitch 2' for convenience of the storage of the keyboard. As shown by FIG. 19, when the second base plate 30 is located at the storage position, the protrusion 284 of the bracket 28 is separated from the supporting portion 300 of the second base plate 30. Because the supporting portion 300 of the second base plate 30 no longer supports the bracket 28, the bracket 28 will rotate relative to the second base plate 30 in the direction A1, so that the keycap 22 moves from the upward position to the downward position through the supporting device 24. In the meanwhile, the magnetic attraction force between the second magnetic area 282 and the first magnetic area 208 can keep the keycap 22 at the downward position.

Furthermore, when the second base plate 30 is moved from the operation position to the storage position in the direction A3, the linkage portions 304 and 306 and the trigger portions 2414 and 2434 are staggered. Therefore, when the second base plate 30 is located at the storage position so that the keycap 22 is kept at the downward position, the trigger portions 2414 and 2434 of the supports 240 and 242 will not trigger the switches 260 and 262 of the circuit board 26.

When the user wants to use the keyboard with the keyswitch 2, the user can move the second base plate 30 from the storage position (as shown by FIG. 18 and FIG. 20) to the operation position (as shown by FIG. 15 and FIG. 16) in a direction A4. When the second base plate 30 moves from the storage position to the operation position in the direction A4, the slanting portion 302 of the second base plate 30 will push against the protrusion 284 of the bracket 28 to lift the bracket 28, so that the protrusion 284 of the bracket 28 abuts against the supporting portion 300 of the second base plate 30. In the meanwhile, the bracket 28 will rotate in the direction A2 relative to the second base plate 30, so that the keycap 22 moves from the downward position to the upward position through the supporting device 24. When the keycap 22 is located at the upward position and the second base plate 30 is located at the operation position, the use can press the keycap 22 for executing a corresponding input function.

Figure 23:
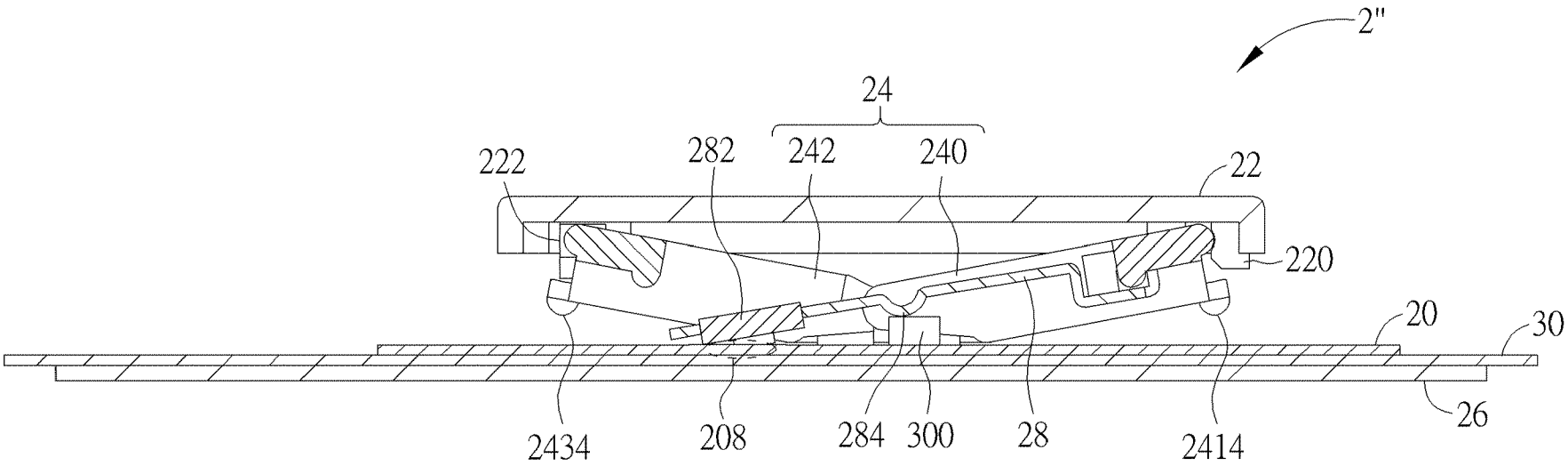
FIG. 23 is a sectional view of the keyswitch along the line Z-Z in FIG. 21.
Figure 24:
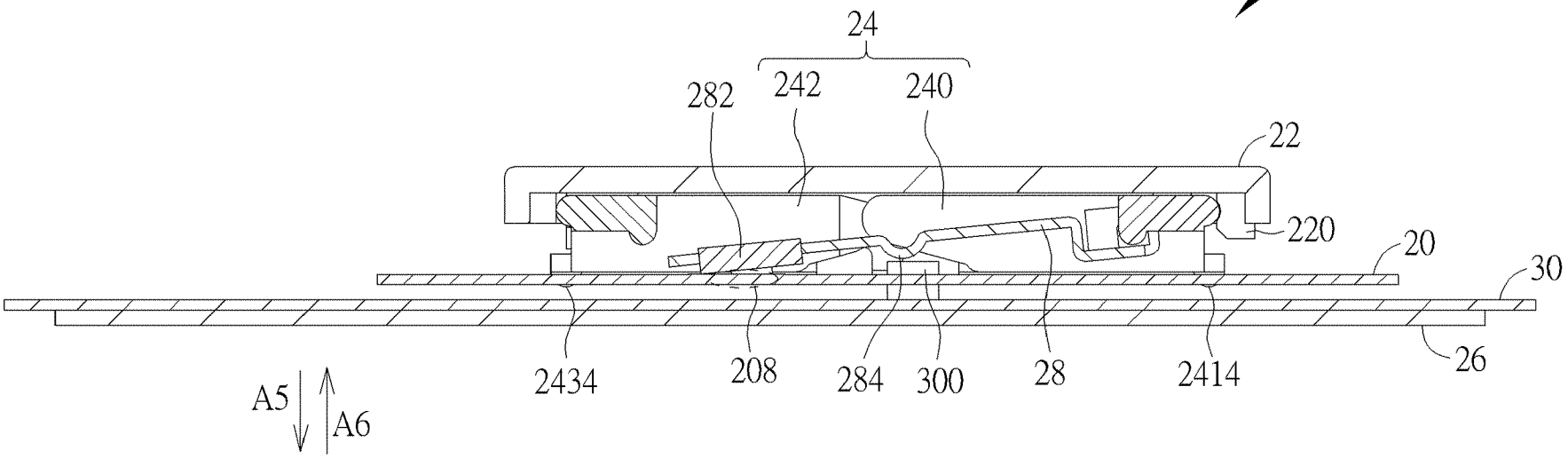
FIG. 24 is a sectional view of the keyswitch in FIG. 23 when a second base plate thereof is moved to a storage position.

Please refer to FIG. 21 to FIG. 24. A keyswitch 2" of another embodiment according to the invention includes a first base plate 20, a keycap 22, a supporting device 24, a circuit board 26, a bracket 28, and a second base plate 30. The circuit board 26 is disposed opposite to the second base plate 30. In the embodiment, the circuit board 26 is disposed under the second base plate 30 and moves along with the second base plate 30; however, it is not limited thereto in practice. For example, it is practicable that the circuit board 26 is disposed under the first base plate 20 and will not move up and down along with the second base plate 30. For another example, it is practicable that the circuit board 26 is disposed under the second base plate 30 and will not move up and down along with the second base plate 30. A difference between the keyswitch 2" and the above-mentioned keyswitch 2 is that the second base plate 30 of the keyswitch 2" moves between an operation position (as shown by FIG. 23) to a storage position (as shown by FIG. 24) in a direction perpendicular to the first base plate 20; therein, the operation position is higher than the storage position. In the embodiment, the second base plate 30 can be provided without the above-mentioned slanting portion 302.

As shown by FIG. 23, when the second base plate 30 is located at the operation position, the protrusion 284 of the bracket 28 abuts against the supporting portion 300 of the second base plate 30, and the magnetic attraction force between the second magnetic area 282 and the first magnetic area 208 keeps the keycap 22 at the upward position. In the meanwhile, the supporting portion 300 of the second base plate 30 abuts against the bracket 28, so that the pivotal connection section of the bracket 28 pushes against the supporting device 24 so as to keep the keycap 22 at the upward position. It is noted that for descriptions about variants of the bracket 28, please refer to the foregoing, which will not be described herein in addition. Furthermore, when the second base plate 30 is at the operation position and the keycap 22 is pressed, the action of the keyswitch 2" can refer to the foregoing about the action of the keyswitch 2, which will not be described herein in addition.

When a keyboard with the keyswitch 2" is not in use, a user can move the second base plate 30 from the operation position (as shown by FIG. 23) to the storage position (as shown by FIG. 24) in a direction A5 (i.e. perpendicular to the first base plate 20), so as to reduce the height of the keyswitch 2" for convenience of the storage of the keyboard. When the second base plate 30 moves from the operation position to the storage position, the supporting portion 300 moves down along with the second base plate 30 and then will not abut against the bracket 28 any longer. Because the bracket 28 cannot sustain the weight of the bracket 28, the supporting device 24, and the keycap 22 through the pivotal connection section of the bracket 28, the pivotal connection section will move downward. Therefore, the supporting device 24 loses the supporting force by the pivotal connection section of the bracket 28, so that the keycap 22 cannot remain at the upward position and then moves down to the downward position due to the weight of the keycap 22 and the supporting device 24. In other words, when the second base plate 30 moves from the operation position to the storage position, the bracket 28 and the supporting device 24 moves in response to the movement of the supporting portion 300, so that the keycap 22 moves from the upward position to the downward position through the supporting device 24. In the meanwhile, the magnetic attraction force between the second magnetic area 282 and the first magnetic area 208 keeps the keycap 22 at the downward position.

Furthermore, when the second base plate 30 moves from the operation position to the storage position in the direction A5, the circuit board 26 moves along with the second base plate 30 in the direction A5, so that the switches 260 and 262 is away from the trigger portions 2414 and 2434 of the supports 240 and 242. Therefore, when the second base plate 30 is located at the storage position so that the keycap 22 is kept at the downward position, the trigger portions 2414 and 2434 of the supports 240 and 242 will not trigger the switches 260 and 262 of the circuit board 26.

When the user wants to use the keyboard with the keyswitch 2", the user can move the second base plate 30 from the storage position (as shown by FIG. 24) to the operation position (as shown by FIG. 23) in a direction A6 (i.e. perpendicular to the first base plate 20). When the second base plate 30 moves from the storage position to the operation position in the direction A6, the supporting portion 300 of the second base plate 30 will push against the protrusion 284 of the bracket 28 to lift the bracket 28, so that the keycap 22 moves from the downward position to the upward position through the supporting device 24. When the keycap 22 is located at the upward position and the second base plate 30 is located at the operation position, the use can press the keycap 22 for executing a corresponding input function.

Furthermore, when a keyboard with the keyswitch 2" is applied to a notebook computer, it is practicable to connect the second base plate 30 to a hinge shaft, which pivotally connects an upper cover and a lower base of the notebook computer, through a linkage mechanism. When the upper cover is opened relative to the lower base or is closed to the lower base, the linkage mechanism will drive the second base plate 30 to move between the operation position and the storage position. The lower base of the notebook computer can reserve a space (of which the height is above 0.3 mm to 0.5 mm) therein for the second base plate 30 and the circuit board 26 to move up and down.

As described above, in the keyswitch according to the invention, the bracket is movably disposed between the keycap and the first base plate. The second magnetic area is disposed on the bracket. Therein, the second magnetic area is disposed opposite to the first magnetic area of the first base plate. Furthermore, the second base plate is disposed opposite to the first base plate. The second base plate moves between the operation position and the storage position. When the second base plate is located at the operation position, the magnetic attraction force between the second magnetic area and the first magnetic area can keep the keycap at the upward position. When the keycap is pressed by an external force such that the second magnetic area moves away from the first magnetic area, the keycap is moved from the upward position to the downward position through the supporting device. When the external force is removed from the keycap, the magnetic attraction force makes the second magnetic area approach the first magnetic area, so that the keycap is moved from the downward position back to the upward position through the supporting device. Because the keyswitch according to the invention has no need of the resilient part used in the keyswitch in the prior art, the lifetime of the keyswitch according to the invention can be elongated.

In another aspect, when the second base plate is located at the storage position, the keycap moves from the upward position to the downward position through the supporting device, and the magnetic attraction force between the second magnetic area and the first magnetic area can keep the keycap at the downward position. Therefore, when a keyboard with the keyswitch according to the invention is not in use, a user can move the second base plate from the operation position to the storage position to reduce the height of the keyswitch for convenience of the storage of the keyboard.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch, comprising:

a keycap;

a first base plate having a first magnetic area;

a supporting device disposed between the keycap and the first base plate, the keycap moving between an upward position and a downward position through the supporting device;

a bracket movably disposed between the keycap and the first base plate, the bracket having a second magnetic area opposite to the first magnetic area; and a second base plate disposed opposite to the first base plate, the second base plate moving between an operation position and a storage position, the second base plate having a supporting portion;

wherein when the second base plate is located at the operation position, the bracket abuts against the supporting portion, and a magnetic attraction force between the second magnetic area and the first magnetic area keeps the keycap at the upward position; and when the second base plate is located at the storage position, the bracket is separated from the supporting portion, and the magnetic attraction force keeps the keycap at the downward position.

2. The keyswitch according to claim 1, wherein when the second base plate is located at the operation position and the keycap is pressed by an external force, the supporting device drives the bracket to move on the supporting portion as a fulcrum to move the second magnetic area away from the first magnetic area, so that the keycap moves from the upward position to the downward position through the supporting device, and when the external force is removed from the keycap, the first magnetic area and the second magnetic area magnetically attract each other, so that the second magnetic area drives the bracket to move on the supporting portion as a fulcrum and approaches the first magnetic area to drive the supporting device so that the keycap moves from the downward position to the upward position through the supporting device.

3. The keyswitch according to claim 1, wherein the bracket has a protrusion, when the second base plate is located at the operation position, the protrusion abuts against the supporting portion, and when the second base plate is located at the storage position, the protrusion is separated from the supporting portion.

4. The keyswitch according to claim 1, wherein the second base plate has a slanting portion, the slanting portion is connected to the supporting portion, when the second base plate moves from the storage position to the operation position, the slanting portion lifts the bracket so that the bracket abuts against the supporting portion, and the keycap moves from the downward position to the upward position through the supporting device.

5. The keyswitch according to claim 1, further comprising a circuit board disposed above the second base plate, wherein the circuit board moves along with the second base plate between the operation position and the storage position.

6. The keyswitch according to claim 5, wherein the supporting device has a trigger portion, the circuit board has a switch, when the second base plate is located at the operation position, the switch is opposite to the trigger portion, when the keycap is pressed by an external force, the keycap moves from the upward position to the downward position through the supporting device so that the trigger portion triggers the switch, and when the second base plate moves from the operation position to the storage position, the circuit board moves along with the second base plate so that the switch and the trigger portion are staggered.

7. The keyswitch according to claim 1, further comprising a circuit board disposed under the second base plate, wherein the supporting device has a trigger portion, the circuit board has a switch, the switch is opposite to the trigger portion, the second base plate has a linkage portion, when the second base plate is located at the operation position, the linkage portion is located between the trigger portion and the switch, when the keycap is pressed by an external force, the keycap moves from the upward position to the downward position through the supporting device so that the trigger portion drives the linkage portion to trigger the switch, and when the second base plate moves from the operation position to the storage position, the linkage portion and the trigger portion are staggered.

8. The keyswitch according to claim 1, wherein one of the first magnetic area and the second magnetic area is a magnetic part, and the other of the first magnetic area and the second magnetic area is a magnetic part or a part made of a paramagnetic material.

9. A keyswitch, comprising:

a keycap;

a first base plate having a first magnetic area;

a supporting device disposed between the keycap and the first base plate, the keycap moving between an upward position and a downward position through the supporting device;

a bracket movably disposed between the keycap and the first base plate, the bracket having a second magnetic area opposite to the first magnetic area; and a second base plate disposed opposite to the first base plate, the second base plate moving between an operation position and a storage position, the second base plate having a supporting portion, the bracket abutting against the supporting portion;

wherein when the second base plate is located at the operation position, a magnetic attraction force between the second magnetic area, and the first magnetic area keeps the keycap at the upward position; and when the second base plate moves from the operation position to the storage position, the bracket and the supporting device moves in response to the supporting position, the keycap moves from the upward position to the downward position through the supporting device, and the magnetic attraction force keeps the keycap at the downward position.

10. The keyswitch according to claim 9, wherein when the second base plate is located at the operation position and the keycap is pressed by an external force, the supporting device drives the bracket to move on the supporting portion as a fulcrum to move the second magnetic area away from the first magnetic area, so that the keycap moves from the upward position to the downward position through the supporting device, and when the external force is removed from the keycap, the first magnetic area and the second magnetic area magnetically attract each other, so that the second magnetic area drives the bracket to move on the supporting portion as a fulcrum and approaches the first magnetic area to drive the supporting device so that the keycap moves from the downward position to the upward position through the supporting device.

11. The keyswitch according to claim 9, wherein the bracket has a protrusion, and the protrusion abuts against the supporting portion.

12. The keyswitch according to claim 9, further comprising a circuit board disposed opposite to the second base plate, wherein the circuit board moves along with the second base plate between the operation position and the storage position.

13. The keyswitch according to claim 12, wherein the supporting device has a trigger portion, the circuit board has a switch, when the second base plate is located at the operation position, the switch is opposite to the trigger portion, when the keycap is pressed by an external force, the keycap moves from the upward position to the downward position through the supporting device so that the trigger portion triggers the switch, and when the second base plate moves from the operation position to the storage position, the circuit board moves along with the second base plate so that the switch is away from the trigger portion.

14. The keyswitch according to claim 9, wherein one of the first magnetic area and the second magnetic area is a magnetic part, and the other of the first magnetic area and the second magnetic area is a magnetic part or a part made of a paramagnetic material.

15. A keyswitch, comprising:

a keycap;

a first base plate having a first magnetic area and a slight protrusion;

a supporting device disposed between the keycap and the first base plate, the keycap moving between an upward position and a downward position through the supporting device;

a bracket movably disposed between the keycap and the first base plate, the bracket having a second magnetic area opposite to the first magnetic area; and a second base plate disposed opposite to the first base plate, the second base plate moving between an operation position and a storage position, the second base plate having a supporting portion;

wherein when the second base plate is located at the operation position, the supporting portion of the second base plate pushes up the slight protrusion of the first base plate so that the bracket abuts against the slight protrusion, and a magnetic attraction force between the second magnetic area and the first magnetic area keeps the keycap at the upward position; and when the second base plate is located at the storage position, the supporting portion and the slight protrusion are staggered so that the slight protrusion is away from the bracket, and the magnetic attraction force keeps the keycap at the downward position.

* * * * *